US008784002B2

(12) United States Patent
Ringus et al.

(10) Patent No.: US 8,784,002 B2
(45) Date of Patent: Jul. 22, 2014

(54) TRACK SYSTEM FOR USE WITH VEHICLES AND METHODS REGARDING SAME

(75) Inventors: Gary J. Ringus, Plymouth, MN (US); Michael Peschel, Corcoran, MN (US)

(73) Assignee: Property Props, Inc., Plymouth, MN (US)

( * ) Notice: Subject to any disclaimer, the term of this patent is extended or adjusted under 35 U.S.C. 154(b) by 0 days.

(21) Appl. No.: 13/554,351

(22) Filed: Jul. 20, 2012

(65) Prior Publication Data

US 2013/0022397 A1 Jan. 24, 2013

Related U.S. Application Data

(60) Provisional application No. 61/509,959, filed on Jul. 20, 2011.

(51) Int. Cl.
*E01C 5/14* (2006.01)

(52) U.S. Cl.
CPC ..... *E01C 5/14* (2013.01)
USPC ..... 404/46; 404/36; 404/73; 14/2.5

(58) Field of Classification Search
CPC ..... E01C 5/14
USPC ..... 404/34–41, 46, 72, 73, 75, 85; 14/2.4–2.6
See application file for complete search history.

(56) References Cited

U.S. PATENT DOCUMENTS

| | | | | |
|---|---|---|---|---|
| 352,146 | A | 11/1886 | Oungst | |
| 1,069,045 | A * | 7/1913 | Turner | 180/9 |
| 1,071,091 | A | 8/1913 | Rogers | |
| 2,384,395 | A | 9/1945 | Payne | |
| 2,393,655 | A * | 1/1946 | Robeck | 280/762 |
| 3,258,800 | A * | 7/1966 | Robinsky | 14/27 |
| 3,348,459 | A * | 10/1967 | Harvey | 404/35 |
| 3,415,013 | A | 12/1968 | Galbraith | |
| RE27,147 | E | 6/1971 | Harvey | |
| 4,024,595 | A * | 5/1977 | Brown | 14/2.4 |
| 4,277,201 | A | 7/1981 | Abell | |
| 4,488,833 | A * | 12/1984 | Perry et al. | 404/35 |
| 4,645,377 | A * | 2/1987 | Vesterby | 405/74 |
| 4,681,482 | A * | 7/1987 | Arciszewski et al. | 404/35 |
| 4,695,502 | A | 9/1987 | Rush | |
| 4,766,020 | A * | 8/1988 | Ellingson, Jr. | 428/54 |
| 5,118,542 | A | 6/1992 | McLeod | |
| 5,157,804 | A | 10/1992 | Williams | |
| 5,275,502 | A | 1/1994 | Glaza et al. | |
| 5,282,692 | A | 2/1994 | McLeod | |
| 5,368,416 | A | 11/1994 | Cataldo | |
| 5,375,369 | A | 12/1994 | VerHoeve | |
| 5,535,545 | A | 7/1996 | Matz | |
| 5,833,386 | A | 11/1998 | Rosan et al. | |

(Continued)

OTHER PUBLICATIONS

A photograph of material in use or on sale prior to Jul. 20, 2010 (1 page).

*Primary Examiner* — Raymond W Addie
(74) *Attorney, Agent, or Firm* — Mueting, Raasch & Gebhardt, P.A.

(57) ABSTRACT

A track system may include a plurality of connected slat members that may form rollable tracks. The rollable tracks may be used in moving vehicles across sensitive ground. The rollable track may be deployed using various methods and/or apparatus such as, e.g., deployment apparatus including one or more spool portions for rolling and unrolling the rollable tracks.

18 Claims, 20 Drawing Sheets

(56) References Cited

U.S. PATENT DOCUMENTS

| | | | | |
|---|---|---|---|---|
| D416,096 | S | 11/1999 | Tisbo et al. | |
| 6,413,013 | B1 * | 7/2002 | Requena | 404/94 |
| 6,592,288 | B2 * | 7/2003 | Chun | 404/71 |
| 6,643,977 | B1 | 11/2003 | Drysdale | |
| 6,685,391 | B1 | 2/2004 | Gideon | |
| 7,090,430 | B1 | 8/2006 | Fletcher et al. | |
| 7,210,876 | B2 | 5/2007 | Moralez et al. | |
| 7,344,340 | B2 | 3/2008 | Carlson et al. | |
| 7,364,383 | B2 | 4/2008 | Fletcher et al. | |
| 7,399,145 | B2 | 7/2008 | Clark | |
| 7,546,654 | B2 * | 6/2009 | Carmel | 14/2.4 |
| 7,774,991 | B2 | 8/2010 | Fletcher et al. | |
| 7,849,642 | B2 | 12/2010 | Forster et al. | |
| 2005/0053429 | A1 | 3/2005 | Davidsaver et al. | |
| 2006/0051161 | A1 | 3/2006 | Benson | |
| 2012/0121341 | A1 | 5/2012 | Ringus et al. | |

* cited by examiner

TRACK SYSTEM FOR USE WITH VEHICLES AND METHODS REGARDING SAME

CROSS-REFERENCE TO RELATED APPLICATION

This application claims the benefit of U.S. Provisional Application Ser. No. 61/509,959, filed 20 Jul. 2011, entitled "TRACK SYSTEM FOR USE WITH WHEELED VEHICLES AND METHODS REGARD SAME," which is incorporated herein by reference in its entirety.

BACKGROUND

The present disclosure relates generally to track systems and methods for deploying the same.

Vehicles (e.g., such as vehicles carrying large or heavy loads) are often required to travel across terrain (e.g., sensitive and/or vulnerable terrain, etc.) to reach their destination point (e.g., trucks, skid loaders, or forklifts carrying materials, such as rock, blocks, or soil, for landscaping, construction vehicles traversing a beautified grass green of a park, etc.). When these vehicles drive across such sensitive and/or vulnerable terrain (e.g., unpaved grounds, such as a grassy area), they often leave deep tread marks as a result of their weight and often destroy the turf which needs to be repaired or replaced resulting in significant costs and/or degraded appearance of the grounds (e.g., in grassy areas of golf courses, cemeteries, parks, etc.).

Groundskeepers spend considerable time maintaining landscaped areas and repairing damage created by such vehicles. Alternatively, the vehicles are not allowed to traverse the ground, instead requiring manpower alone to transport goods across terrain to avoid damage. Use of manpower alone can take considerably more time and effort, and may still result in terrain damage.

SUMMARY

These problems may be addressed by having such vehicles travel over sensitive and/or vulnerable terrain with use of a track system (e.g., which may provide for such travel without leaving deep tread marks or damage to turf requiring repair). The systems and methods of this disclosure permit a track system to be put down (e.g., mechanically or manually by hand) and further permit or allow a vehicle to travel over a temporary track system (e.g., including at least one rollable track, two or more rollable or assembled tracks, etc.) that disperses weight such that tread marks and/or damages are minimized or avoided all together.

One embodiment of a track system along which, when deployed, a vehicle may move is described herein. The track system may include first and second rollable tracks. Each of the rollable tracks may include a plurality of connected slat members forming a track length of the rollable track (e.g., each of the plurality of connected slat members may be formed of solid material). Each of the plurality of connected slat members may include a slat length extending from a first end to a second end, a slat width perpendicular to the slat length extending from a first connection interface to a second connection interface (e.g., the slat width may be less than the slat length), and a slat thickness perpendicular to the slat width and the slat length (e.g., wherein the slat width may be greater than the slat thickness, and even greater than at least twice the slat thickness). The first connection interface of each slat member may be slidably connectable to the second connection interface of a different slat member. The first connection interface of each slat member may include a tongue portion and the second connection interface of each slat member may include a groove portion (e.g., channel, slot, etc.). The tongue portion of the first connection interface of each slat member (e.g., a T-shaped tongue portion) may be receivable within the groove portion of the second connection interface of a different slat member to slidably connect the first connection interface to the second connection interface along a connection axis therebetween such that the connected slat members may be partially rotatable relative to each other about the connection axis to allow the plurality of connected slat members to be rolled up into a track roll. In at least one embodiment, the tongue portion of the first connection interface of at least one connected slat member may not be received within the groove portion of the second connection interface of a different slat member to define a gap between connected slat members. Further, each rollable track may include two or more strap elements. Each strap element may be coupled along the track length of the rollable track. Further, each strap element may be coupled to each of the plurality of connected slat members at a pivot point such that the connected slat members may allow for a limited slidable movement relative to each other along the connection axis between connected slat members. In at least one embodiment, each of the rollable tracks may further include at least one connector element coupled to a connected slat member proximate an end region of the track length. The at least one connector element may be configured to couple the rollable track to another rollable track.

One embodiment of the exemplary track system may be used in moving vehicles across sensitive ground. The system may include a track system for a deployment vehicle that first unrolls and then drives along the deployed track. Further, the system may include more than one rollable track system that includes connected slats and a mechanized system and/or apparatus such as a vehicle for deploying the rollable track.

In at least another embodiment, each pivot point located along the length of the plurality of connected slat members may include a fastener placed through the strap element and into the slat member.

In at least another embodiment, each rollable track may include a first side and a second side along the track length. A first strap element may be coupled along the track length between the midpoint of the slat length of connected slat members and the first side of the rollable track while a second strap element may be coupled along the track length between the midpoint of the slat length of the connected slat members and the second side of the rollable track.

In at least one embodiment, one of the strap elements may include flexible material.

In at least one embodiment, the tongue portion of each of the plurality of connected slat members may define a T-shape.

In at least one embodiment, the connected slat members may be partially rotatable such that one of the connected slat members is rotatable in a range of about 1 degrees to about 60 degrees relative to an adjacent connected slat member about the connection axis.

In at least another embodiment, the strap element between slat members may be flexible and the limited slidable movement between connected slat members may be in a range of about 0.5 inches to about 2 inches.

In at least one embodiment, the slat length may be more than twice the width of a deployment vehicle's tires.

One embodiment of an exemplary method deploying a track system (e.g., for use in moving vehicles across sensitive and/or vulnerable grounds) is also described. The method may include providing at least one track roll (e.g., one or more track rolls such as the rollable tracks described herein assembled in a roll), and loading the at least one track roll onto a deployment vehicle and unrolling them from the same. Further, the method may include unrolling the at least one track roll such that the plurality of connected slat members of the at least one track roll may be deployed in front of wheels of the deployment vehicle (e.g., such that the deployment vehicle may be able to drive on top of the unrolled plurality of connected slat members, such as the unrolled single track or unrolled multiple tracks).

In at least one embodiment, the method may include controlling the rate of unrolling the at least one track roll. In at least one embodiment, the method may include loading the at least one roll behind a cabin of the deployment vehicle and unrolling them from the same location.

In at least one embodiment, the method may include loading the at least one roll above a cabin of the deployment vehicle and unrolling them from the same location. In at least one embodiment, the method may include loading the at least one roll in front of a cabin of the deployment vehicle and unrolling them from the same location.

One exemplary deployment apparatus for use in a track system (e.g., a track system including first and second rollable tracks) may include a first spool portion for the first rollable track, a second spool portion for the second rollable track, and an axle portion. Each spool portion of the first and second spool portions may be configured to hold the rollable tracks above a ground surface. Further, each spool portion may extend along a spool axis and may be rotatable about the axis to roll and unroll the rollable tracks from the spool portion. Still further, each spool portion of the first and second spool portions may define connector apparatus configured to be coupled to a rollable track. The axle portion may be coupled to each of the first and second spool portions and may extend along the spool axis between the first and second spool portions.

In one or more embodiments, the deployment apparatus may further include a mounting portion couplable to a vehicle and configured to hold the axle portion and the first and second spool portions above the ground surface. The mounting portion may be further configured to control the rate of rolling and unrolling of the first and second rollable tracks. In at least one embodiment, the deployment apparatus may further include a first engagement wheel fixedly coupled to one of the axle and the first and second spool portions and a second engagement wheel rotatably coupled to the mounting portion. The second engagement wheel may be positionable in an engaged configuration and a disengaged configuration. The second engagement wheel may be in contact with the first engagement wheel to apply reverse tension to the first engagement wheel when in the engaged configuration. The second engagement wheel may not be in contact with the first engagement wheel when in the disengaged configuration.

In one or more embodiments, the mounting portion may include at least one J-shaped bracket configured to interface with the axle portion to hold the axle portion and the first and second spool portions above the ground surface. Further, a spool width may be defined between the first and second spool portions and the first and second spool portions and the axle portion may be configured to allow the spool width to be adjustable. In at least one embodiment, the second engagement wheel may be movable along a movement axis parallel to the spool axis to engage the first engagement wheel.

One exemplary deployment apparatus for use in a track system may include a spool portion for at least one rollable track. The spool portion may be configured to hold the at least one rollable track above a ground surface and may extend along a spool axis and may be rotatable about the axis to roll and unroll the at least one rollable track from the spool portion. The spool portion may further define connector apparatus configured to be coupled to the at least one rollable track.

The above summary is not intended to describe each embodiment or every implementation of the present disclosure. A more complete understanding will become apparent and appreciated by referring to the following detailed description and claims taken in conjunction with the accompanying drawings.

DETAILED DESCRIPTION OF EXEMPLARY EMBODIMENTS

Figure 1:
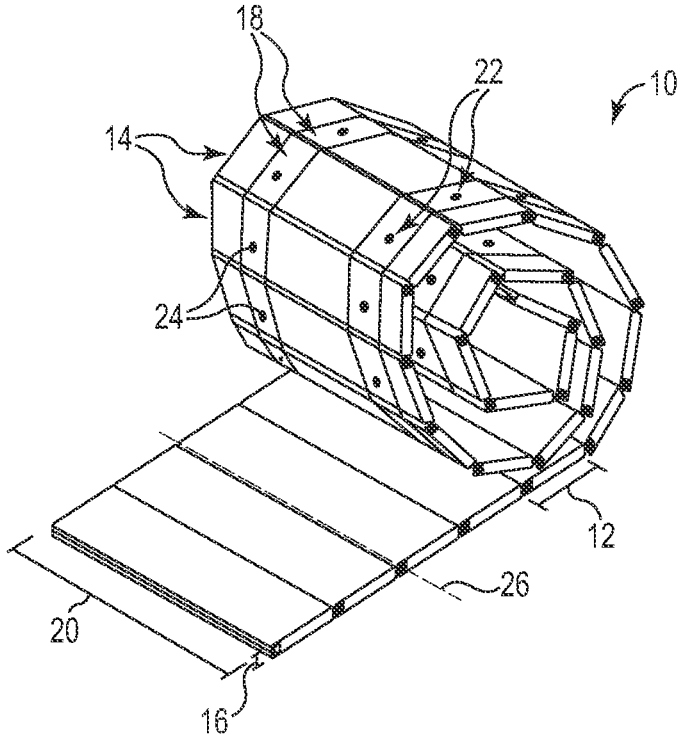
FIG. 1 is a perspective view of a rollable track of a track system (e.g., a roll of slat members coupled together and bound by flexible straps).

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary embodiments shall be described with reference to FIGS. 1-11. It will be apparent to one skilled in the art that elements (e.g., method steps, materials, etc.) from one embodiment may be used in combination with elements of the other embodiments, and that the possible embodiments of methods and apparatus using combinations of features set forth herein is not limited to the specific embodiments shown in the figures and/or described herein. Further, it will be recognized that the embodiments described herein may include many elements that are not necessarily shown to scale. Still further, it will be recognized that the size and shape of various elements herein may be modified but still fall within the scope of the present disclosure, although certain one or more shapes and/or sizes, or types of elements, may be advantageous over others.

Figure 2:
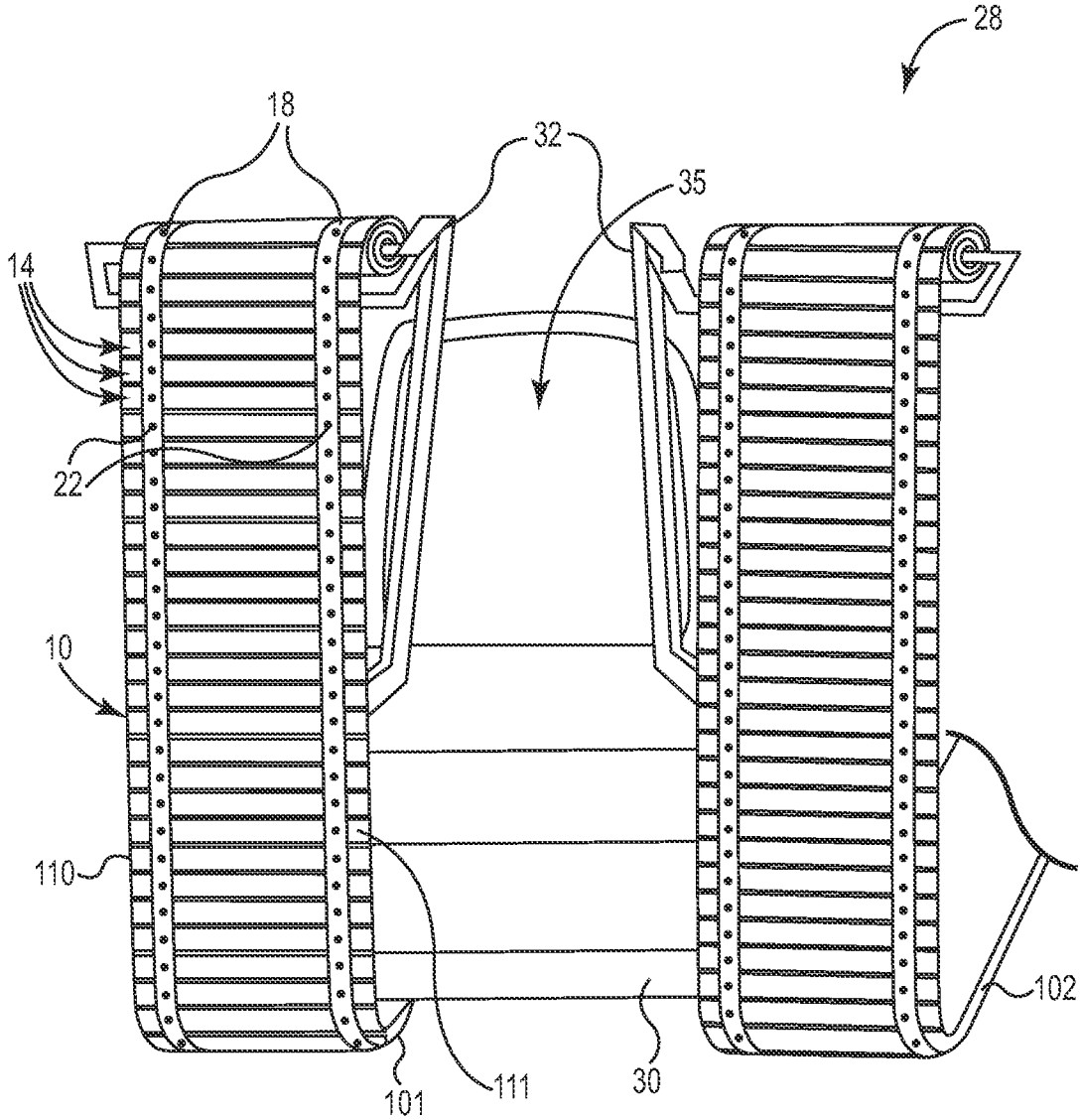
FIG. 2 is a front perspective view of a deployment vehicle with deployment apparatus having track rolls thereon being unrolled from the same.
Figure 3:
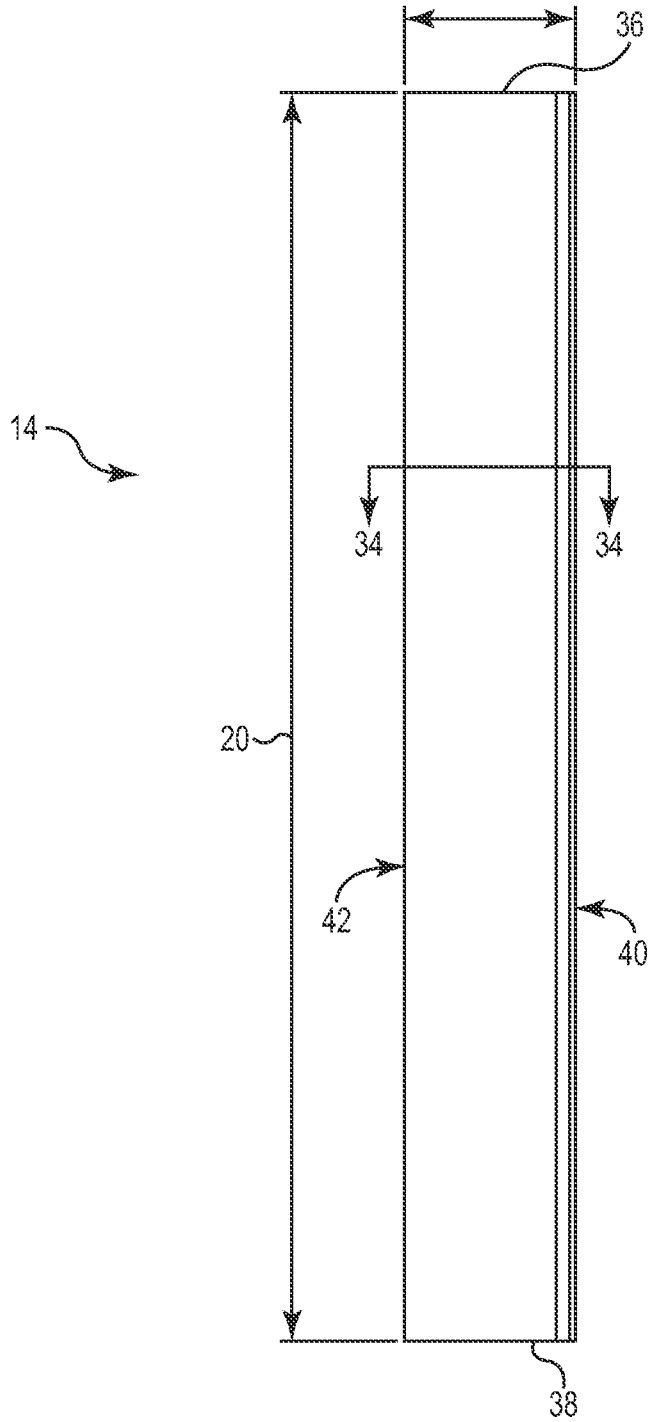
FIG. 3 is a plan view of an exemplary slat member.

Various exemplary materials may be used with the exemplary systems and methods described herein for use in minimizing the impact of vehicles (e.g., such as vehicles carrying large or heavy loads) driving across sensitive and/or vulnerable ground (e.g., landscaped grounds of a cemetery, golf course, residential or commercial landscaped property, etc.). Further, for example, as shown in FIG. 2, first and second tracks 101 and 102 may be deployed according to the present disclosure such that a vehicle's tires (not shown) can move over the tracks. However, a single track roll 10, or rollable track, (e.g., having slat members of sufficient length, carried on a single spool or two or more spools, etc.) may be deployed such that the vehicle's tires (not shown) and/or tracks (e.g., on tracked vehicles) can move over the single unrolled track.

One exemplary material that may be used to provide the first and second tracks 101 and 102 may be a track roll 10 (e.g., rollable track) as depicted in FIG. 1 (e.g., a track roll 10 may be used to provide each of the first and second tracks 101 and 102). The track roll 10 (e.g., a rolled or assembled track that is rollable) may include a plurality of connected slat members 14 as described with reference to FIGS. 1-7.

In one embodiment, the number of connected slat members 14 used to provide the track roll 10 depends on a track length of the rollable track (e.g., the plurality of connected slat members form a track length upon which the vehicle may move along). For example, the track length may be a length required for a deployment vehicle 30 (e.g., a skid loader) to reach a required destination (e.g., a single rollable track or multiple rollable tracks 10 (e.g., connected or unconnected) may be used to get a vehicle or other moving person or object to a desired destination).

In one embodiment, each of the slat members 14 extends from a first end 36 to a second end 38 defining a slat length 20 therebetween (e.g., generally orthogonal to the length of the rollable track). In at least one embodiment, the slat member 14 is formed of solid material. In other words, the slat member 14 may not be hollow. In at least another embodiment, the slat member 14 may not be formed of solid material (e.g., cavities may exist within the slat member 14) as long as the slat member 14 is still strong enough for a deployment vehicle 30 to drive upon it without causing damage to the slat member 14 when connected to other slat members 14.

In at least one embodiment, the slat member 14 may be impermeable such that the passage of liquid, water, sand, soils, etc. through the slat member 14 is impeded or prevented when deployed as described herein. Further, the slat members 14 may be formed of a polymer, wood, metal, fiberglass, cement, and/or combinations thereof. In at least one embodiment, the slat members 14 may be formed of ultraviolet light-protected and weather-tolerant, recycled plastic. Still further, the slat members 14 may have various colors and/or patterns of colors. For example, the slat members 14 may be brown, yellow, "sand" colored, green, "grass" colored, brown, "soil" colored, red, "pine-needle" colored, black, grey, and/or any combination thereof.

In one or more embodiments, the slat member 14 may extend from a first connection interface 40 to a second connection interface 42 defining a slat width 12 therebetween (e.g., generally in the direction of the length of the rollable track and orthogonal to the length 20 of the slat member). Similar to slat length 20, the slat width 12 of the slat member 14 may also be dependent on use. In other words, certain applications of the track system may require longer or shorter slat lengths 20 and slat widths 12 than others. For example, for larger or heavier vehicles (e.g., those being larger or heavier, or those carrying larger or heavier loads) may require longer, wider, and/or thicker slat members 14 to carry the vehicle weight without damage, may require longer slat members 14 to correspond to the size of tires on a vehicle, etc. Further, the slat length 20 of the slat members 14 may be limited by the visibility needs of the driver of the deployment vehicle 30 as depicted in FIG. 2. In other words, the slat length 20 and slat width 12 of a slat member 14 may be determined by the deployment vehicle's 30 weight that must be supported with consideration of the limitation of the deployment vehicle 30 driver's visibility (e.g., such as, when the track rolls 10 are positioned for deployment in front of the vehicle's cabin, the length 20 of the slat members 14 may be limited such that the driver can still see between the track rolls as they are being unrolled in front of the deployment vehicle 30).

In at least one embodiment, the slat width 12 may be about 1 inch or greater, about 2 inches or greater, or about 3 inches or greater. Further, in at least one embodiment, the slat width 12 may be about 2 inches or less, about 3 inches or less, about 5 inches or less, about 10 inches or less, or about 12 inches or less. Further, in one or more embodiments, the slat length 20 may be greater than about 20 inches, greater than about 25 inches, greater than about 30 inches, or greater than about 36 inches. Further, in one or more embodiments, the slat length 20 may be less than about 36 inches, less than about 48 inches, less than about 6 ft., or less than 8 ft. Still further, in one or more embodiments, the slat length 20 may be more than the width of a vehicles tire, and may be more than twice the width of the vehicle's tire.

Figure 4:
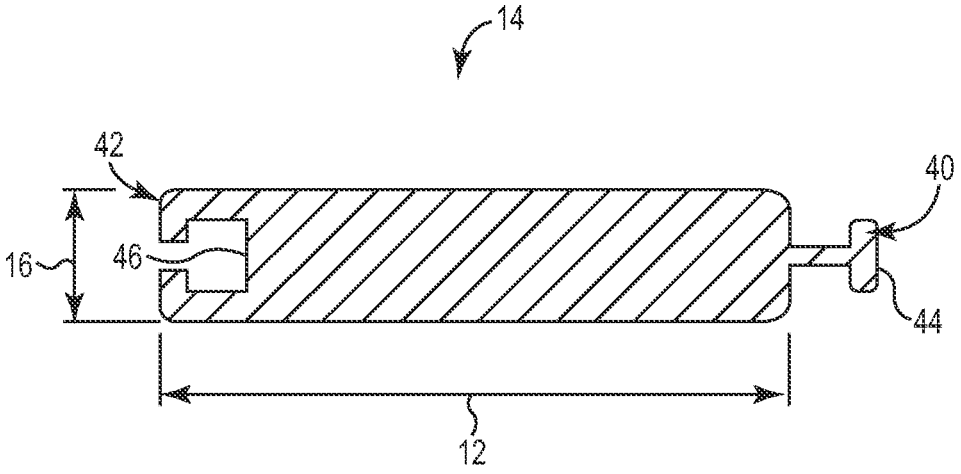
FIG. 4 is a cross sectional view of the slat member of FIG. 3 as taken across line 34-34.

The slat member 14 further defines a slat thickness 16 perpendicular to the slat width 12 and the slat length 20 of the slat member 14 as shown in the cross-sectional view of the slat member 14 taken across line 34-34 as depicted in FIG. 4. The slat thickness 16 of the slat member 14 may be defined in terms of the slat width 12. For example, the slat thickness 16 of the slat member 14 may be about less than half the slat width 12. In other words, the slat width 12 of the slat member 14 may be greater than about at least twice the slat thickness 16. In at least one embodiment, the slat thickness 16 may be about 0.5 inches or greater, about 1 inch or greater, about 1.5 inches or greater, or about 2 inches or greater. Further, in at least one embodiment, the slat thickness 16 may be about 1.5 inches or less, about 2 inches or less, about 3 inches or less, or about 4 inches or less.

Figure 5:
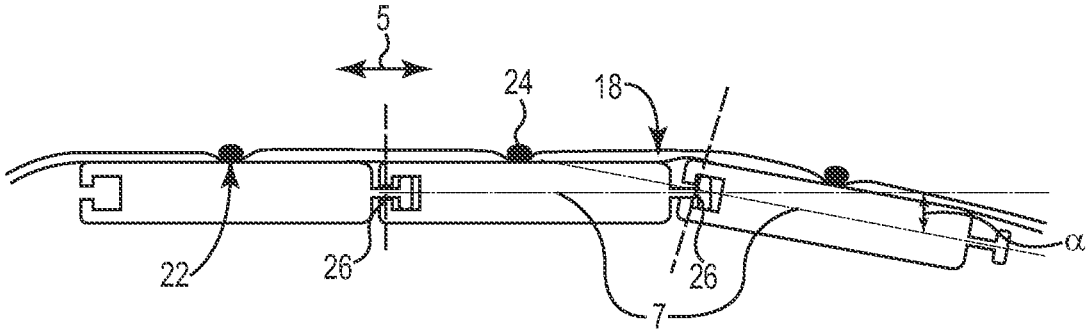
FIG. 5 is an end view of multiple exemplary slat members of FIG. 1 slidably connected together.

The connection interfaces 40, 42 may be configured such that multiple slat members 14 may be slidably connectable with each other, e.g., as shown in FIG. 5, to form a plurality of connected slat members 14 (e.g., forming the length of the rollable track). More specifically, the first connection interface 40 of a slat member 14 may be slidably connectable along a connection axis 26 to the second connection interface 42 of a different slat member 14. Each of the connection interfaces 40, 42 may extend along the entire length 20 of the slat member 14.

Further, after two slat members 14 have been slidably connected, movement of the slat members 14 with respect to each other may be restricted in a direction perpendicular to their slat lengths 20 and/or slat thickness 16 from being disconnected from each other. In other words, two slat members 14 may not be pulled apart laterally, e.g., the directions depicted by the double-sided arrow 5 in FIG. 5, without deforming or breaking one or both of the connection interfaces 40, 42. For example, the two slat members 14 may form an interlocking connection such that the slat members 14 may only be removed from each other by sliding the slat members 14 with respect to one another in directions parallel to their slat lengths 20. This restrictive functionality may be provided by the type of connection interfaces 40, 42.

In at least one embodiment of a slat member 14, e.g., as depicted, the first connection interface 40 of the slat member 14 may include a tongue portion 44 and the second connection interface 42 of the slat member 14 may include a groove portion 46 (e.g., channel, slot, etc.). The tongue portion 44 of the first connection interface 40 may be receivable within the groove portion 46 of the second connection interface 42 to slidably connect the first connection interface 40 to the second connection interface 42 along the connection axis 26. Each of the tongue portion 44 and the groove portion 46 may extend the entire slat length 20 of the slat member 14 and, with respect to the groove portion 46, the groove portion 46 may open at both the first end 36 and the second end 38. The tongue portions 44 and the groove portions 46 of the slat members 14 may be configured to restrict movement of slat members 14 with respect to each other in a direction perpendicular to their slat lengths 20 and/or slat thicknesses 16 from being disconnected from each other. For example, the tongue portions 44 and the groove portions 46 may form an interlocking connection such that the slat members 14 may only be moved relative to each other by sliding the slat members 14 with respect to one another in directions parallel to their slat lengths 20.

Further, in at least one embodiment, the tongue portion 44 of the slat member 14 may be T-shaped. In other words, the tongue portion 44 may be shaped like the capital letter "T" with the base of the "T" attached to a body portion of the slat member 14 as shown in the cross-section of FIG. 4. Further, the groove portion 46 may be sized and shaped (e.g., like the capital "U") to receive the T-shaped tongue portion 44.

Figure 6:
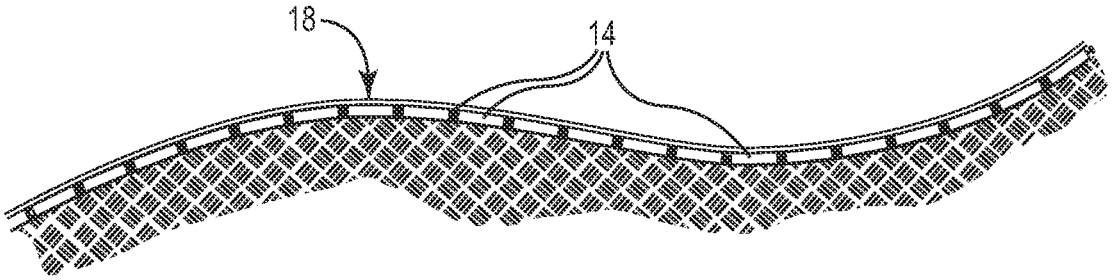
FIG. 6 is a elevation view of an exemplary unrolled or positioned track system.

In one or more embodiments, the first connection interface 40 of each slat member 14 may be receivable within the second connection interface 42 of a different slat member 14 to slidably connect the first connection interface 40 to the second connection interface 42 along the connection axis 26 such that the connected slat members may be partially rotatable relative to each other about the connection axis 26 to allow the plurality of connected slat members 14 to be rolled up into a roll (e.g., track roll 10). Such a track roll 10 may be held together using any mechanism or technique (e.g., plastic straps, mechanical fasteners holding the end of the track roll to the rest of the roll, etc.). Further, such rotation about the connection axis 26 may allow for the unrolled track 10 to take the form of the terrain as shown in FIG. 6 (e.g., following up and down terrain easily, across varying elevations, etc.). As shown in FIG. 6, the strap elements 18 are located on a top side of the slat members 14, which may be an alternative configuration for the tracks 10. In other words, the strap elements 18 may be located on either of the top side (e.g., facing away from a ground surface) or bottom side (e.g., facing a ground surface) of the slat members 14.

In at least one embodiment, the groove portion 46 and/or tongue portion 44 may be sized and shaped relative to each other such that a certain amount of lateral and/or angular movement or "play" may be allowed between two connected slat members 14. For example, the first and second connection interfaces 40, 42 may be configured such that the slat members 14 may rotate with respect to one another about the connection axis 26 aligned with the connection interfaces 40, 42 (e.g., rotate clockwise or counterclockwise about the connection axis 26). This rotation may allow the connected slat members 14 to be formed into a track roll 10 (e.g., rolled up into a track roll 10). In at least one embodiment, a track roll 10 formed of connected slat members 14 may have a radius greater than about 10 inches, or greater than about 15 inches. Further, in at least one embodiment, the radius may be less than about 20 inches, less than about 30 inches, less than about 40 inches, or less than about 50 inches.

Further, one way of describing this rotational movement of one slat member 14 relative to another adjacent and connected slat member 14 about the connection axis 26 is using a plane 7 within which the slat member 14 lies as shown in FIG. 5 (e.g., defining a degree of rotation of one slat member relative to another connected slat member). The plane 7 of a slat member 14 may be allowed to move less than about angle alpha away from plane 7 of the adjacent, slidably connected slat member 14. In other words, the plane 7 of a slat member 14 may be restricted from moving more than angle alpha, e.g., the upper limit, away from the plane 7 of the connected slat member 14 in either direction (e.g., rotate either clockwise or counterclockwise away from the plane 7 about the connection axis 26). In one or more embodiments, angle alpha may be greater than about 0.5 degrees, greater than about 1 degree, greater than about 5 degrees, greater than about 10 degrees, or greater than about 15 degrees. Further, in one or more embodiments, the angle alpha may be less than about 10 degrees, less than about 15 degrees, less than about 20 degrees, less than about 25 degrees, less than about 30 degrees, or less than about 40 degrees. In other words, each slat member 14, or plane 7 thereof, may be capable of rotating relative to the connected adjacent slat member (since the adjacent slidably connected slat member 14 can be rotated in either direction) greater than about 1 degree, greater than about 2 degrees, greater than about 10 degrees, greater than about 24 degrees, or greater than about 30 degrees. Further, such rotation may be less than about 20 degrees, less than about 24 degrees, less than about 40 degrees, less than about 50 degrees, less than about 60 degrees, or less than about 80 degrees.

To slidably connect slat members 14 to each other, the tongue portion 44 at the second end 38 of a slat member 14 may be inserted into the groove portion 46 at the first end 36 of a different slat member 14. After insertion, the slat members 14 may be slid relative to one another such that their second ends 38 may be proximate or near one another. This slidable connection process may be repeated to connect a plurality of slat members 14 to form the rollable track 10. The connected slat members 14 may then undergo a process that connects the plurality of connected slat members 14 along the length of the rollable track 10 (e.g., using at least one strap element 18 along the length of each rollable track).

For example, in one or more embodiments each rollable track 10 may include at least one strap element 18 (e.g., two or more strap elements 18 as depicted) to provide for such connectivity of the plurality of slat members 14 along the length of the rollable track 10. For example, each strap element 18 may be coupled to all of the plurality of connected slat members 14 along the track length of the rollable track 10. Further, for example, in one or more embodiments, each strap element 18 may be coupled to each of the plurality of connected slat members 14 at a pivot point 22 such that the connected slat members 14 may allow for a limited slidable movement relative to each other along the connection axis 26 between connected and adjacent slat members 14 of the plurality of connected slat members 14.

Only a single pivot point 22 along a particular strap element 18 is shown to be created with respect to each slat member 14. However, more than one pivot point 22 may be created along a particular strap element 18 with respect to each slat member 14 if the desired limited slidable movement is maintained.

Such pivot points 22 may be provided in any number of ways. For example, localized intense heating may be used to form openings within the strap element 18 through which fasteners 24 may be inserted and attached to the slat member 14 to create a pivot point 22. The connected slat members 14 may then be rolled into the rollable track 10. However, such pivot points 22 may be created in any other variety of ways. For example, the pivot point 22 may be created by cutting, drilling, hole-punching, and/or a combination thereof. In at least one embodiment, the pivot point 22 may be formed through heating the recycled plastic to melting point. The strap element 18 may be attached at the pivot point 22 by a fastener 24. The fastener 24 may be a bolt, nail, tack and/or a combination thereof. In at least one embodiment, the fastener 24 is a screw.

The strap element 18 may be formed of cotton, nylon, rope, metal, polymers, and/or a combination thereof. In at least one embodiment, the strap element 18 is formed of polyester. Further, the strap element 18 may be flexible. For example, the strap element 18 may be flexible along its width such that it permits the strap element 18 to move such that the connected slat members 14 may slide along the connection axis 26 therebetween a certain distance. Further, for example, the strap element 18 need not include flexibility along its length so as to maintain the plurality of connected slat members 14 in place along the length of the rollable track 10 but still allow for rotation between the adjacent and connected slat members 14 so the rollable track may be rolled.

Figure 7A:
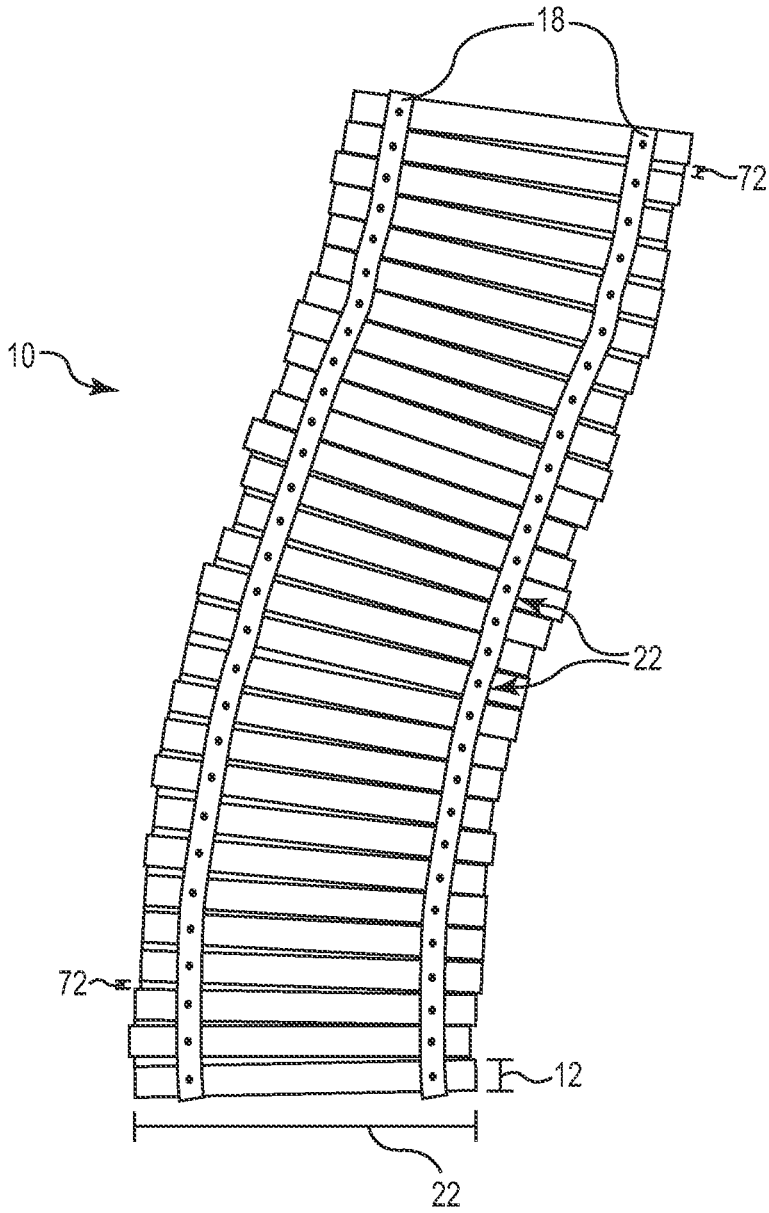
FIG. 7A is a deployed bottom view of an exemplary unrolled or positioned track system showing curvature resulting from the sliding motion (e.g., allowed limited sliding movement) between connected slat members.
Figure 7B:
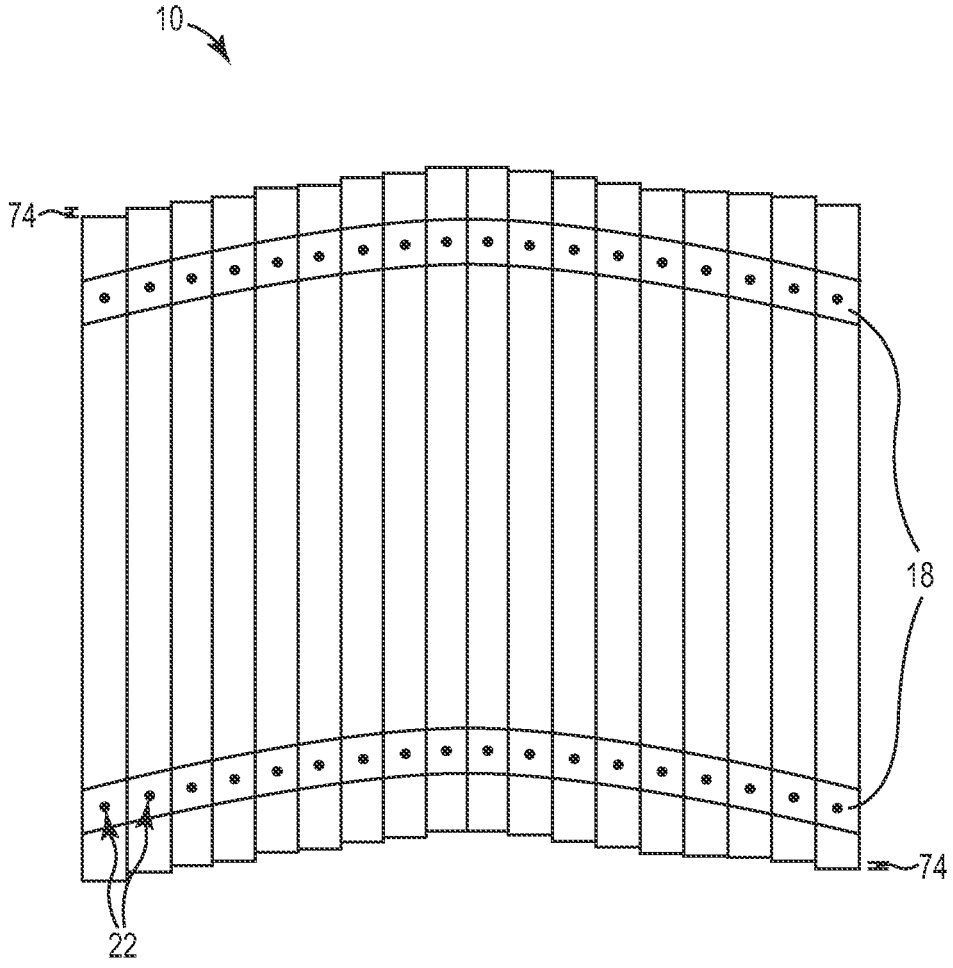
FIG. 7B is a more detailed view of a portion of the track system of FIG. 7A showing curvature.
Figure 7C:
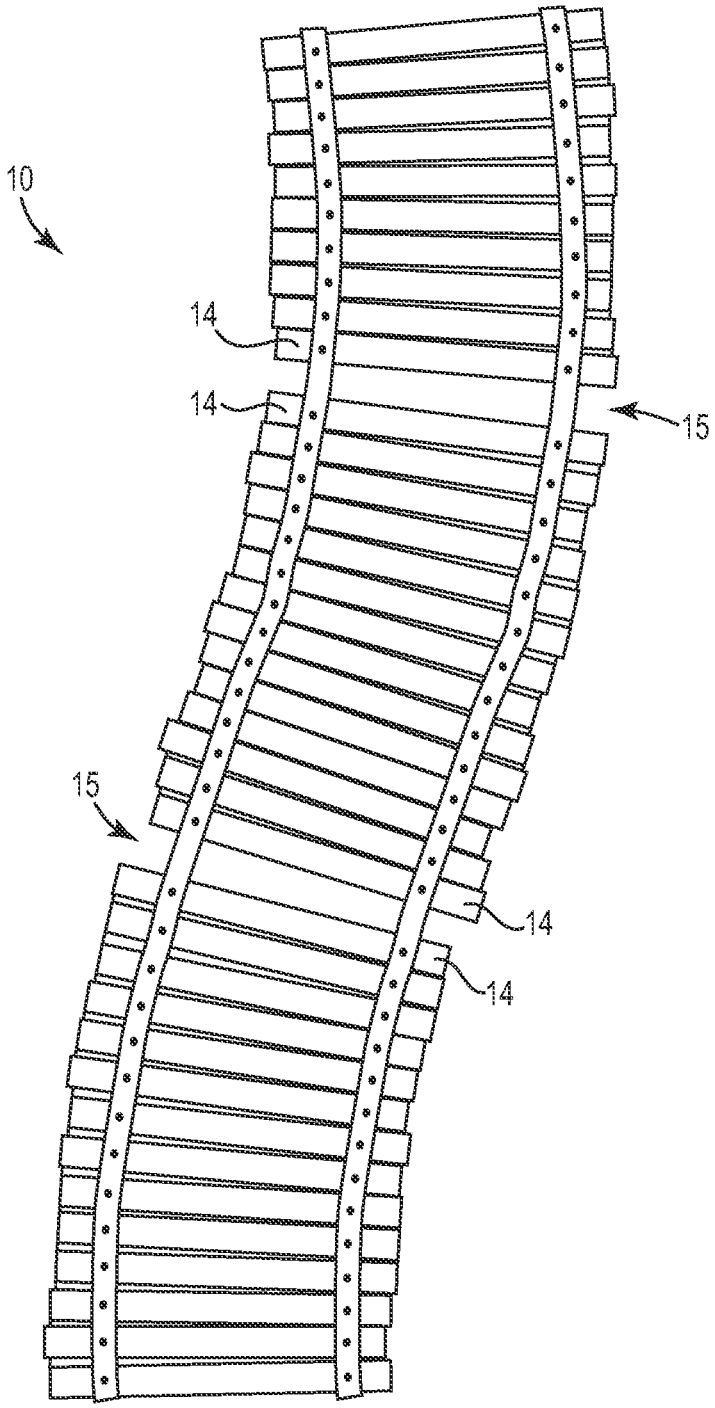
FIG. 7C is the track system of FIG. 7A showing gaps between connected slat members.

In at least one embodiment, the fastening of a strap element 18 to a plurality of connected slat members 14 at pivot points 22 may provide, or allow, for a limited sliding movement or distance 74 (as depicted in FIG. 7B) along the axis 26 between two connected and adjacent slat members 14 (e.g., in either direction). In one or more embodiments, the limited sliding distance 74 may be greater than about 0.125 inches, greater than about 0.25 inches, greater than about 0.5 inches, greater than about 1 inch, or greater than about 2 inches. Further, in one or more embodiments, the limited sliding distance 74 may be less than about 1 inch, less than about 2 inches, less than about 5 inches, or less than about 10 inches. The sliding distance 74 may vary based on the elasticity of the strap element 18 and the tightness with which the strap element 18 is affixed by fasteners 24 to the pivot points 22 on connected slat members 14.

In at least one embodiment, the strap elements 18 as well as the relative size and shape of the groove portion 46 and/or tongue portion 44 may provide a variable gap distance 72 between connected slat members (as depicted in FIG. 7A). In one or more embodiments, the variable gap distance 72 may be greater than about 0.125 inches, greater than about 0.25 inches, greater than about 0.5 inches, greater than about 1 inch, or greater than about 2 inches. Further, in one or more embodiments, the variable gap distance 72 may be less than about 0.25 inch, less than about 0.5 inch, less than about 0.75 inch, less than about 1 inch, or less than about 2 inches. Similar to the limited sliding distance 74, the variable gap distance 72 may vary based on the elasticity of the strap element 18 and the tightness with which the strap element 18 is affixed by fasteners 24 to the pivot points 22 on connected slat members 14.

FIGS. 7A-7B depict how the variable gap distance 72 and the limited sliding distance 74 may allow for the slat members 14 to rack, or racking, which provides curvature in the track system. Various curvatures may be achieved by the rollable track 10 when deployed. The sharpness of the curvature of the deployed track (e.g., tracks 101, 102) may depend on the variable gap distance 72 and/or the limited sliding distance 74 and, thus, the tightness of the strap element 18 fastening restricting the sliding motion. For example, in one or more embodiments, a radius of curvature such as may be necessary to deploy tracks around an obstacle such as a tree, other landscape, corner of building, etc. may be less than 60 feet, less than 40 feet, less than 30 feet, less than 20 feet, or less than 10 feet. Further in one or more embodiments, the radius of curvature may be greater than 10 feet, greater than 20 feet, or even greater indicative of a very gradual curvature. In other words, various curvatures may be accomplished and the present disclosure is not limited to any particular curvature shown or listed.

In at least one embodiment, each slat member 14 may have two or more pivot points 22 along its slat length 20 for attachment of two or more strap elements 18 at such pivot points 22 (e.g., one pivot point 22 for each strap element 18 extending along the length of the rollable track). Such pivot points 22 may be placed at symmetric or asymmetric distances from the midpoint of the slat length 20 of a slat member 14.

Each deployed or unrolled track 101, 102 may include a first side 110 (i.e., adjacent the ends 38 of the slat members 14) and a second side 111 (i.e., adjacent the ends 36 of the slat members 14) along the track length as shown in FIG. 2. In one or more embodiments, the strap elements 18 may each be positioned a distance from the first and second sides 110 and 111 dictating the placement of the pivot points 22.

The placement of the pivot points 22 may depend on the various characteristics of the terrain or requirements of the track system. For example, it may be preferable for the pivot points 22 to be placed closer to the first and second sides 110, 111 than to the mid-point of the slat members 14 (i.e., the mid-point of the slat member length 20) (e.g., so that wear on the strap elements 18 is reduced, so that certain deployment apparatus 32 may be used to unroll the rollable track 10, such as apparatus that may engage the sides of the rolls, etc.).

In at least one embodiment, a first strap element 18 may be coupled along the track length between the midpoint of the slat length 20 of connected slat members 14 and the first side 110 of the rollable track 101 and a second strap element 18 may be coupled along the track length between the midpoint of the slat length 20 of connected slat members 14 and the second side 111 of the rollable track 101. In one or more embodiments, at least a distance of about 2 inches or greater, 3 inches or greater, or 4 inches or greater, may be maintained from the strap element 18 to its respective side 110, 111 of the rollable track 10. Further, in one or more embodiments, at least a distance less than 10 inches, less than 8 inches, or less than 4 inches may be maintained from the strap element 18 to its respective side 110, 111 of the rollable track 10.

Each of the rollable tracks 10 may further include at least one slat member 14 that is not connected to an adjacent slat member 14 forming a gap 15 therebetween as shown in FIG.

7C. More specifically, for example, the tongue portion 44 of the first connection interface 40 of a connected slat member 14 may not be received within the groove portion 46 of the second connection interface 42 of a different slat member 14 to define the gap 15 between connected slat members 14. As shown, the gap 15 may define a width of about the same width as a slat member 14 (e.g., slat width 12). In other embodiments, the gap 15 may be larger or smaller. The gap 15 may, e.g., allow the rollable track 10 to be unrolled and rolled without "bubbles" or "kinking" between sections of connected slat members 14. In at least one embodiment, a gap 15 may be defined between every fifteen slat members 14, or may be defined less often (e.g., less than fifteen slat members 14) or more often (e.g., greater than fifteen slat members 14).

Figure 7D:
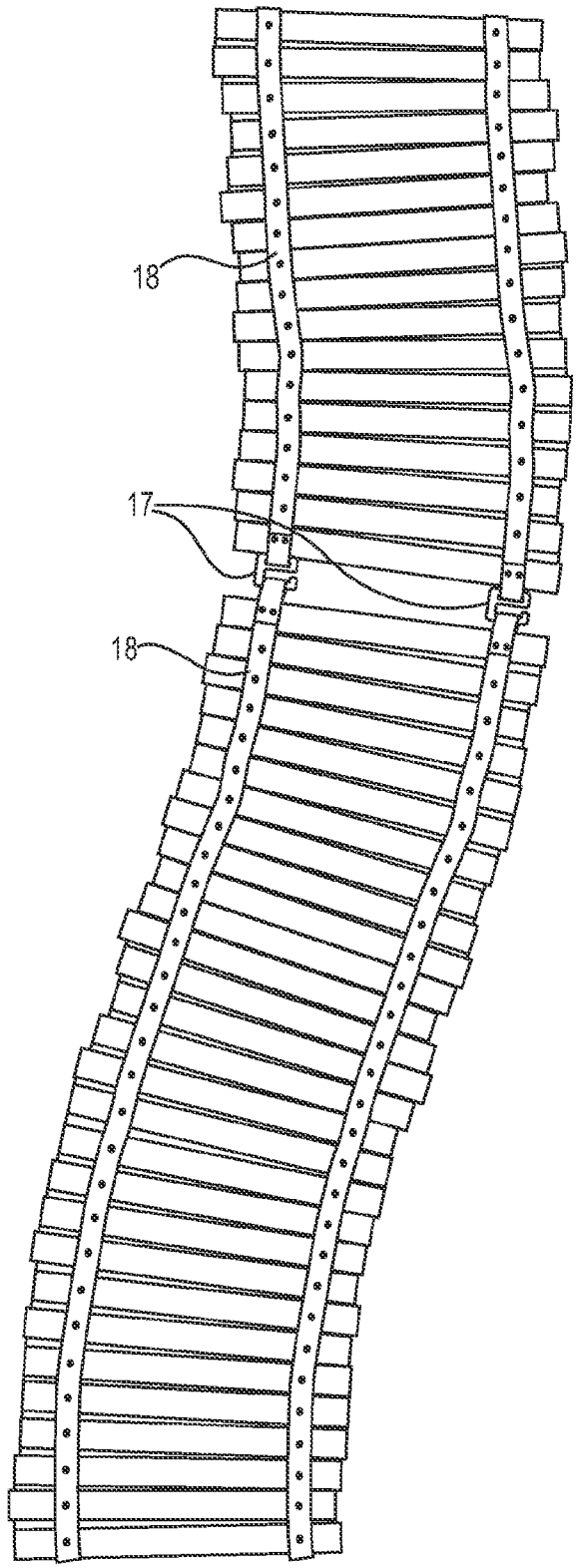
FIG. 7D is the track system of FIG. 7A showing two tracks coupled together.

One or more rollable tracks 10 may be connected or coupled to each other to form longer tracks as shown in FIG. 7D. For example, rollable tracks 10 may come in various sizes such as, e.g., 10 feet, 25 feet, 50 feet, 75 feet, 100 feet, 150 feet, etc., and such various sizes of rollable tracks 10 may be connected or coupled to each to lay down, or unroll, a track of a selected distance. To be coupled to each other, each of the rollable tracks 10 may further include at least one connector element 17. As shown, the two connector elements 17 are coupled to the strap elements 18 of a first track 10, and the connector elements 17 are coupled to the strap elements 18 of a second track 10 thereby coupling the rollable tracks 10 together to form a longer track. More specifically, the connector elements 17 may be metal buckles that may slide into a loop of the strap elements 18 to couple the tracks 10.

As used herein, a "track system" may also be defined as one or more rollable tracks 10 combined with a deployment apparatus 32 and deployment vehicle 30 as shown by the system 28 of FIG. 2. In at least one embodiment, such a system 28 may be used to lay down one or more rollable tracks 10 (e.g., one or more than one at a time) of connected slat members 14 as tracks (e.g., tracks 101, 102) upon which the vehicle (e.g., the vehicle's wheels) may travel without damaging the ground beneath the track.

One embodiment of an exemplary method used in deploying a track system using a deployment apparatus 32 may include providing at least one track roll 10 (e.g., a single track roll having a size for receiving both tires of a vehicle or for a person to walk on, two or more tracks rolls each sized to receive a wheel of the vehicle, or for a person to walk on, etc.). The at least one track roll 10 may be formed of any rollable track configuration as described herein or any other unrollable track that may be deployed thereby. Any rollable tracks 10 may be deployed by one or more persons or users (e.g., grasping and rolling/unrolling the tracks 10).

The deployment method may include loading the at least one track roll 10 onto deployment apparatus 32 (e.g., an attachment to a forklift or a skid loader that holds the track rolls to be deployed and controls the deployment thereof) of a deployment vehicle 30 and unrolling the at least one track roll 10 such that the plurality of connected slat members 14 are deployed in front of the wheels (not shown) of the deployment vehicle 30. In at least one embodiment, the deployment vehicle 30 may include a forklift, skid loader, truck, car, construction vehicle, etc. (e.g., or a vehicle having a combination of the features of such vehicles). In at least one embodiment, the deployment vehicle 30 may be a skid loader or a forklift. In at least one embodiment, the number of track rolls 10 to be deployed may be two or more depending on the needs of the user and/or the requirements of the vehicle 30 to be moved over the tracks.

Figure 8:
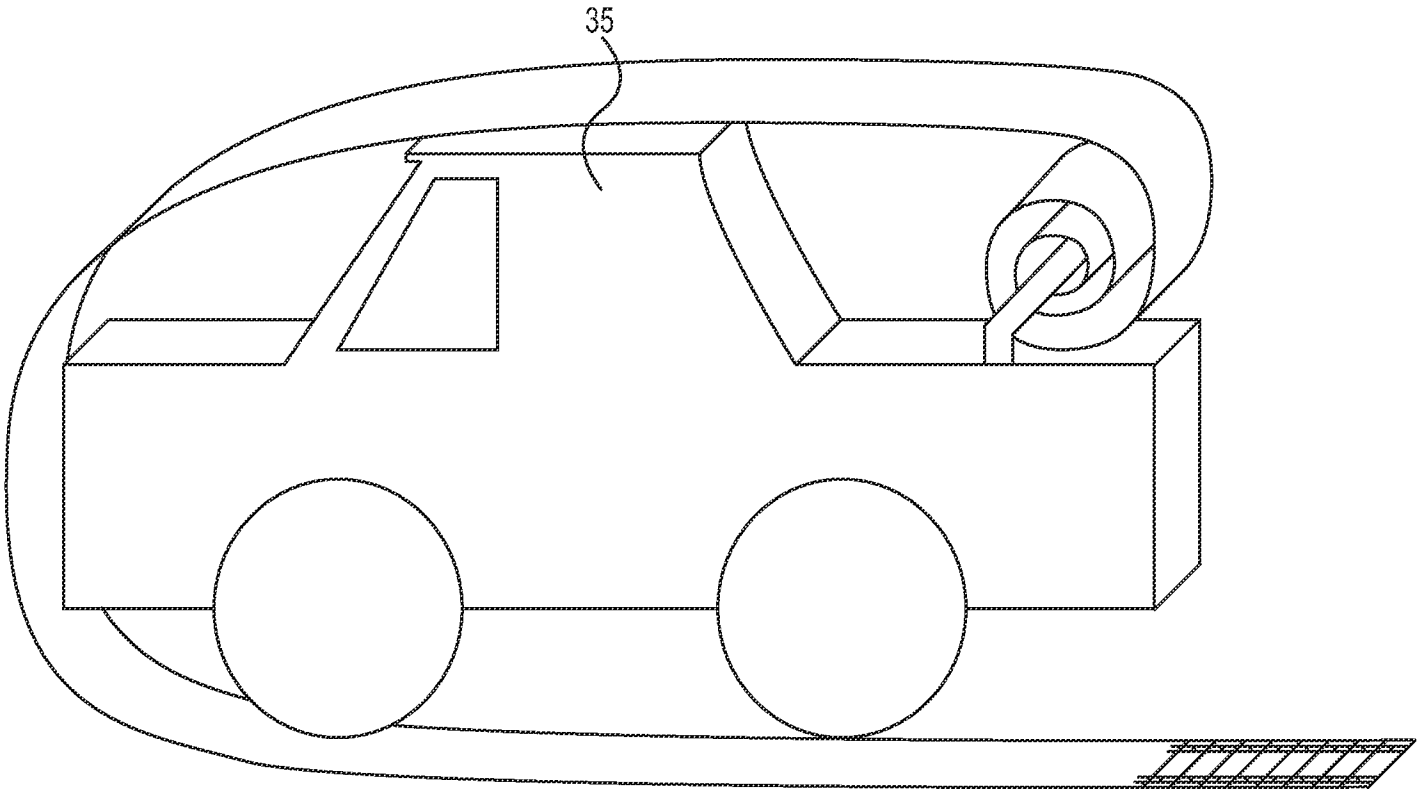
FIG. 8 is a side view of an alternative exemplary embodiment of a deployment vehicle.

In at least one embodiment, the deployment apparatus 32 may be permanently connected to the deployment vehicle 30. The track roll(s) 10 may be loaded and/or held by the deployment apparatus 32 above and/or in front of the deployment vehicle's cabin 35, as depicted in FIG. 2, behind the deployment vehicle's cabin 35, as depicted in FIG. 8, and/or any combination thereof. In at least one embodiment, the track roll(s) 10 are held at least in front of the deployment vehicle's cabin 35.

In at least one embodiment, the rate of unrolling the plurality of track rolls 10 may be controlled. The rate of unrolling the track rolls 10 may be linear, nonlinear, and/or a combination thereof depending on the terrain. The rate of unrolling may be controlled automatically (e.g., rolling the track rolls 10 loosely enough that they are allowed to unroll as the tires of the deployment vehicle 30 drive forward over them), manually (e.g., by crank, hand shaft, physical "rollout" by hand, and/or a combination thereof), and/or by motor.

Additional exemplary deployment apparatus 50 is depicted in FIGS. 9-11. As shown in FIGS. 9A-9B, the deployment apparatus 50 may include a first spool portion 52, a second spool portion 54, and an axle portion 56 coupled between the first spool portion 52 and the second spool portion 54 along a spool axis 58. Each of the spool portions 52, 54 may be configured to hold, load, and unload one or more rollable tracks 10 about the spool portion 52, 54. For example, the spool portions 52, 54 may be rotated about the spool axis to wind and unwind, or roll and unroll, the tracks 10 from the spool portion 52, 54. In other words, the tracks 10 may be loaded or unloaded from the spool portions 52, 54 by rotating the spool portions 52, 54. Although the deployment apparatus 50 depicted herein includes two spool portions 52, 54, and in turn two rollable tracks, it is to be contemplated that exemplary deployment apparatus may utilize a single spool and rollable track or more than two spools and rollable tracks. For example, a single spool portion may be used to roll out, or lay down, a rollable track. Further, for example, a vehicle may user deployment apparatus to deploy a single rollable track wide enough for the entire vehicle to traverse.

The axle portion 56 may be coupled to the first and second spool portions 52, 54 such that when the axle portion 56 rotates, the first and second spool portions 52, 54 rotate at the same time along the spool axis 58. In other words, the axle portion 56 and the spool portions 52, 54 may be rotated together along the spool axis 58. It is to be contemplated, however, that in other embodiments, the axle portion 56 and the spool portions 52, 54 may rotate independently from one another.

Figure 9A:
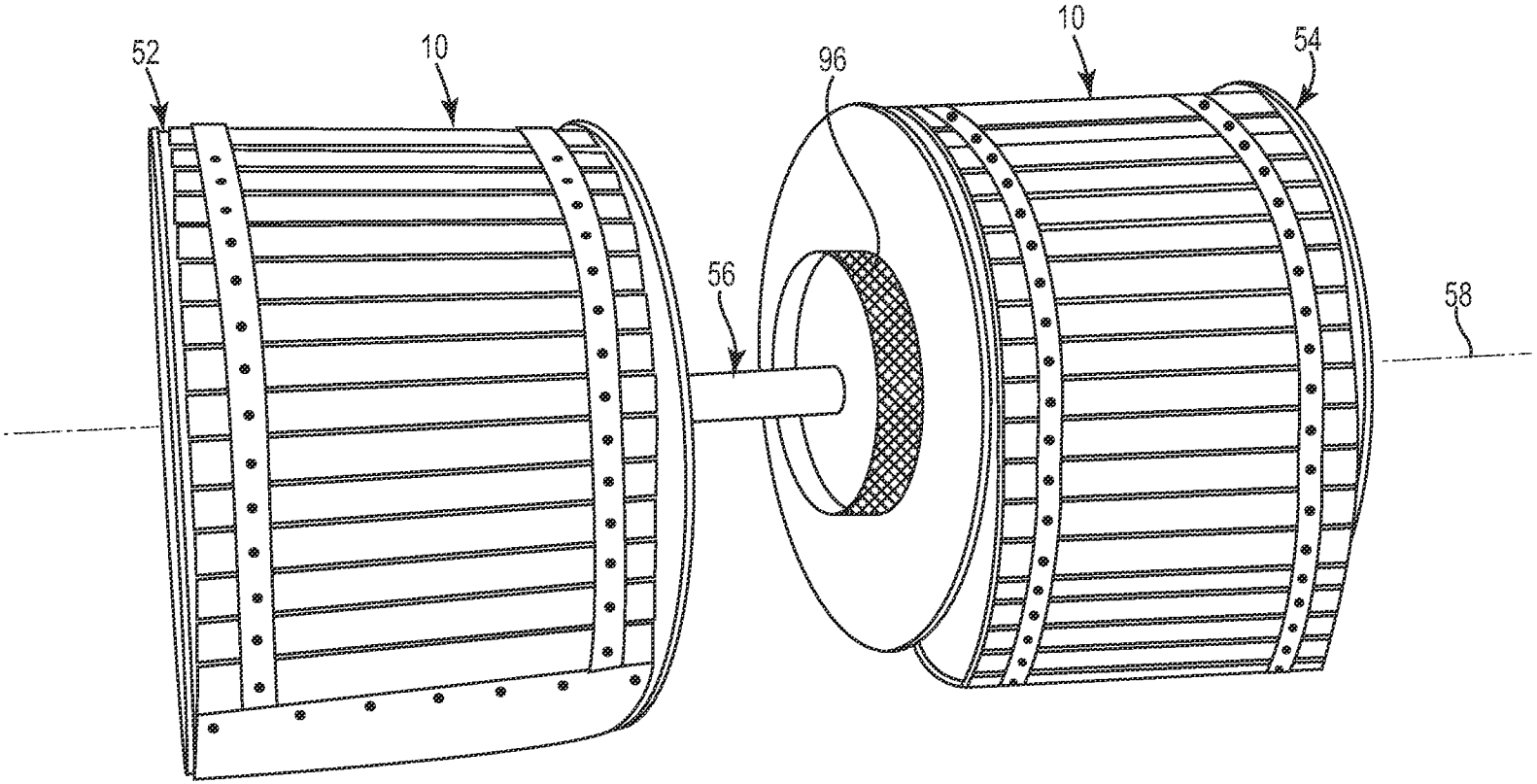
FIG. 9A is a perspective view of an exemplary deployment apparatus for use in a track system.
Figure 9B:
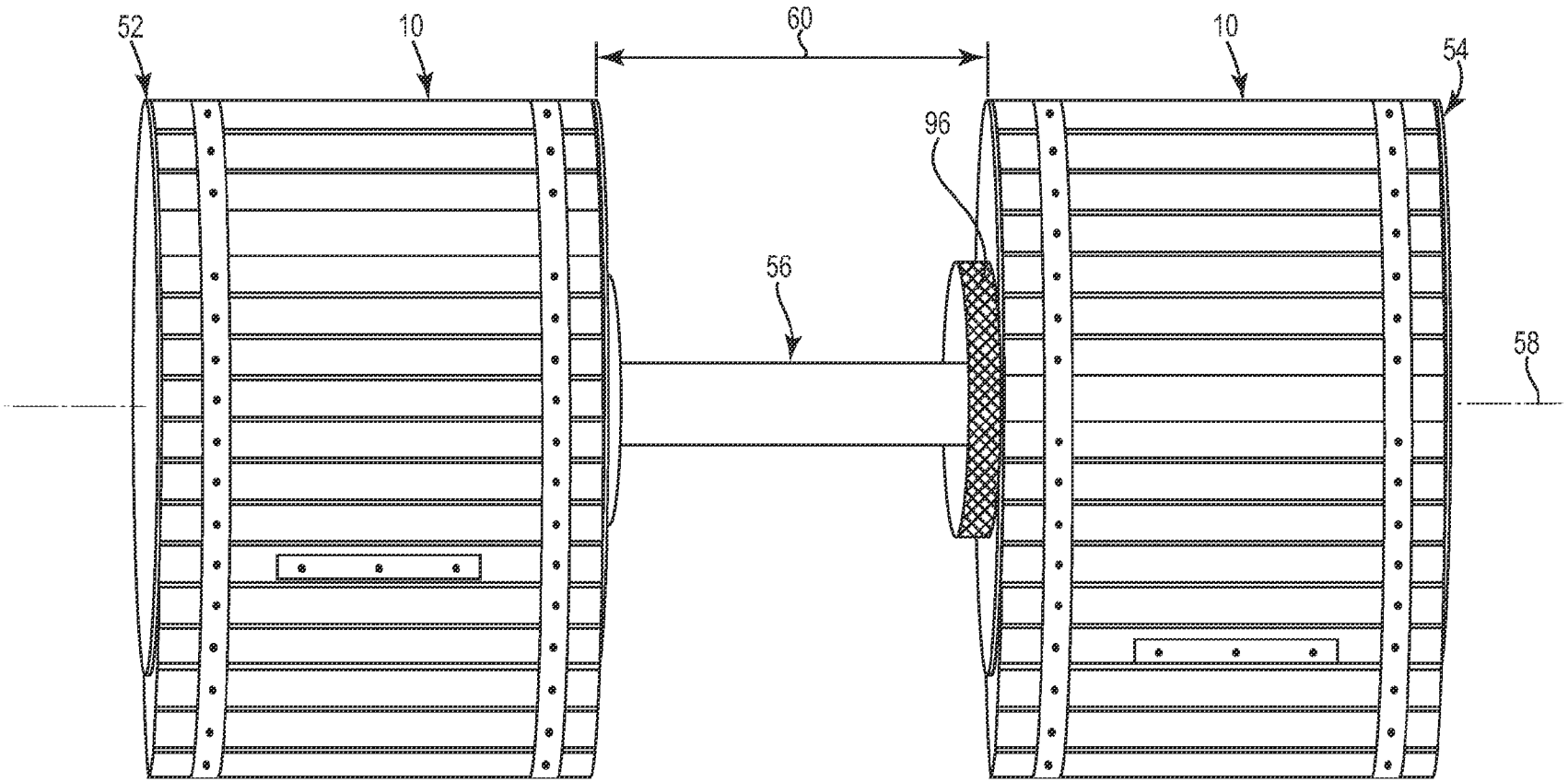
FIG. 9B is a front view of the deployment apparatus of FIG. 9A.

A spool width 60 may be defined between the spool portions 52, 54 as shown in FIG. 9B. The deployment apparatus 50 (e.g., each of the axle 56 and spool portions 52, 54) may be configured such that the spool width 60 is adjustable to, e.g., facilitate vehicles having different track bases (e.g., the width between the two front wheels, the width between the two rear wheels, etc.). In at least one embodiment, the spool width 60 may be adjustable from and between about 2 feet to about 4 feet.

Figure 9C:
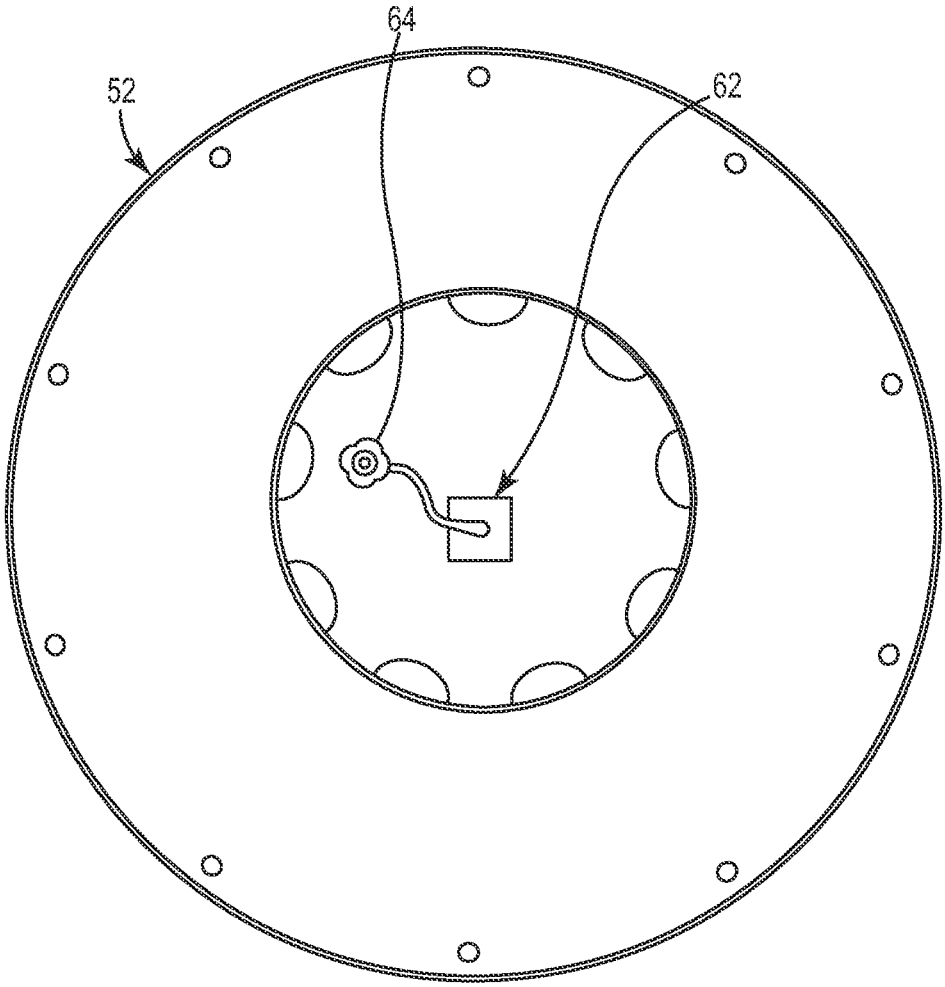
FIG. 9C is a side view of the deployment apparatus of FIG. 9A.

The spool width 60 may be adjustable by using adjustment apparatus 62 such as the crank 64 located on the side of the first spool portion 52 as depicted in FIG. 9C. For example, a user may rotate the crank 64 in a first direction (e.g., clockwise or counterclockwise) to increase the spool width 60 and in a second direction (e.g., opposite the first direction) to decrease the spool width 60.

Figure 9D:
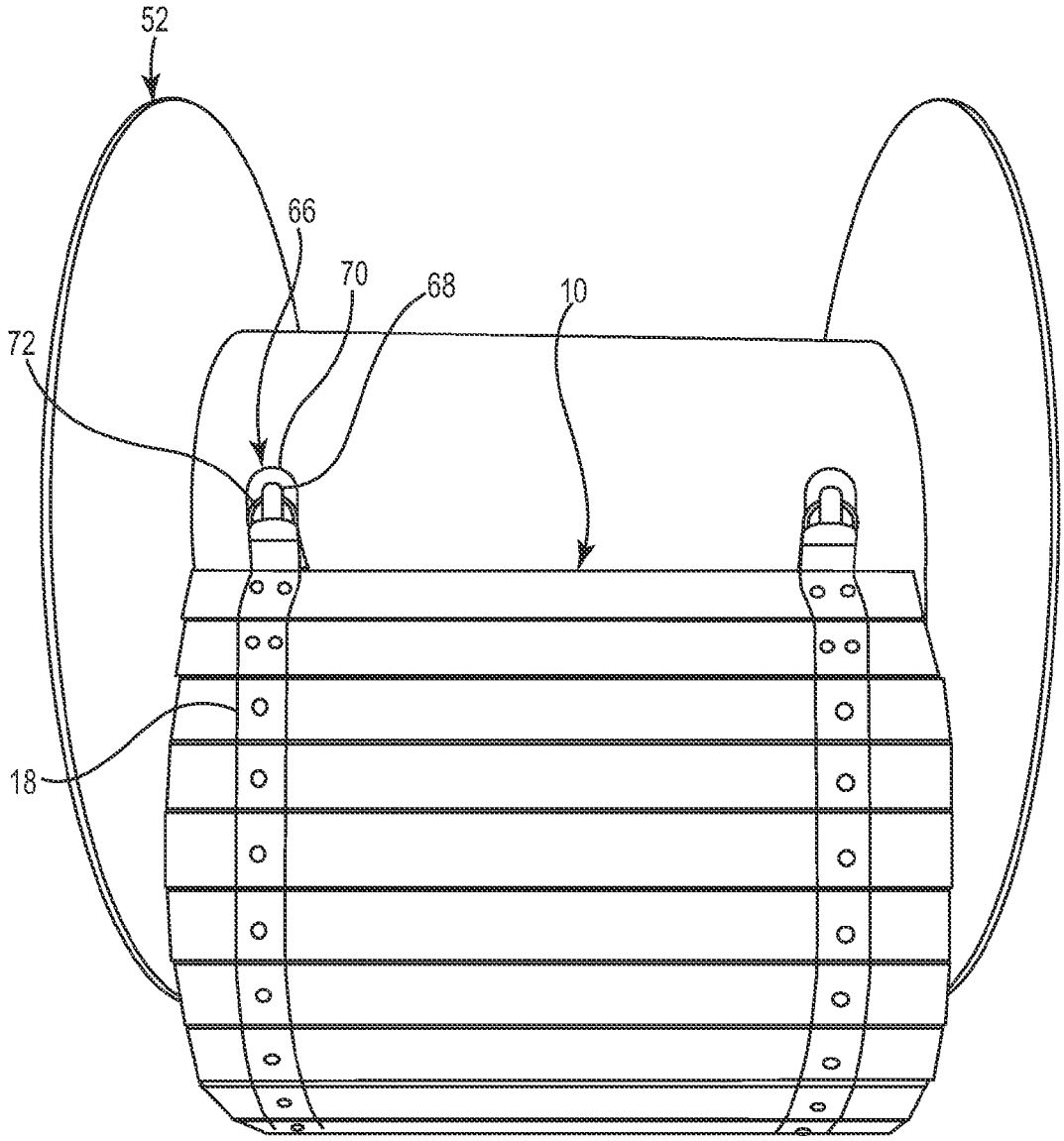
FIG. 9D is a front view of a spool portion of the deployment apparatus of FIG. 9A connected to a rollable track.

The tracks 10 may be removably coupled to the spool portions 52, 54 as shown in FIG. 9D. For example, the spool portions 52, 54 may include connector apparatus 66 configured to be coupled to a track 10. As shown, the connector apparatus 66 include a tongue portion 68 defined within an opening 70 in the spool portion 52, 54 and the track 10 may include a metal loop 72 configured to be coupled to the tongue portion 68. Further, an end region of the strap element 18 proximate the metal loop 72 may be attached to a slat member 14 using two fasteners to, e.g., further secure the strap element 18 proximate the end of a track 10.

Figure 10A:
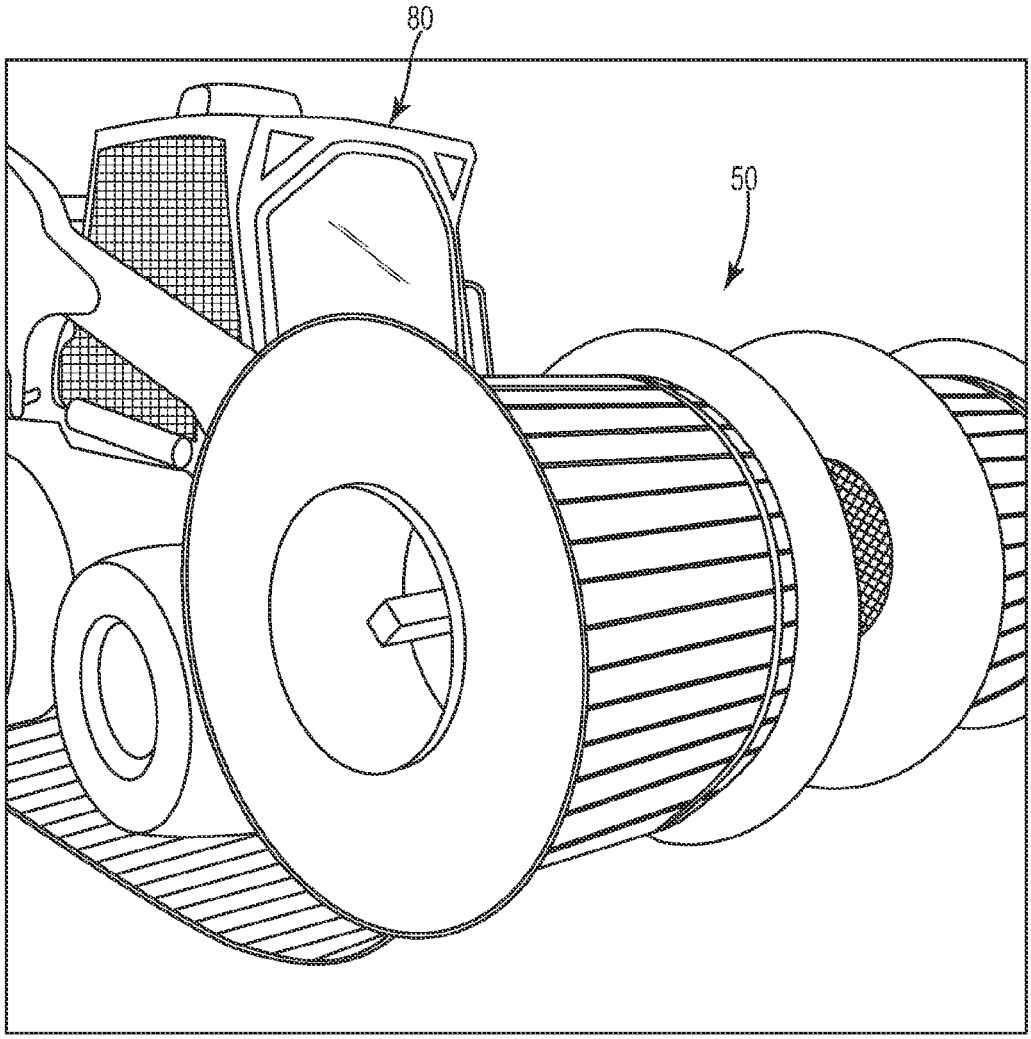
FIG. 10A is a perspective view of exemplary deployment apparatus attached to a vehicle deploying rollable tracks.
Figure 10B:
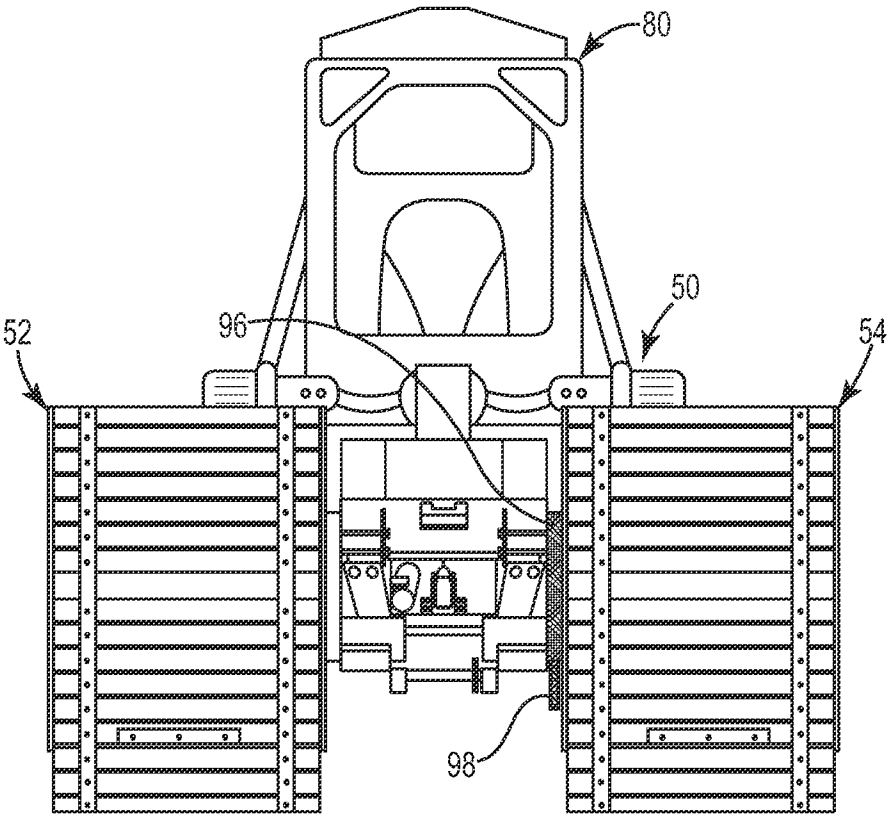
FIG. 10B is a front view of the deployment apparatus and vehicle of FIG. 10A.
Figure 10C:
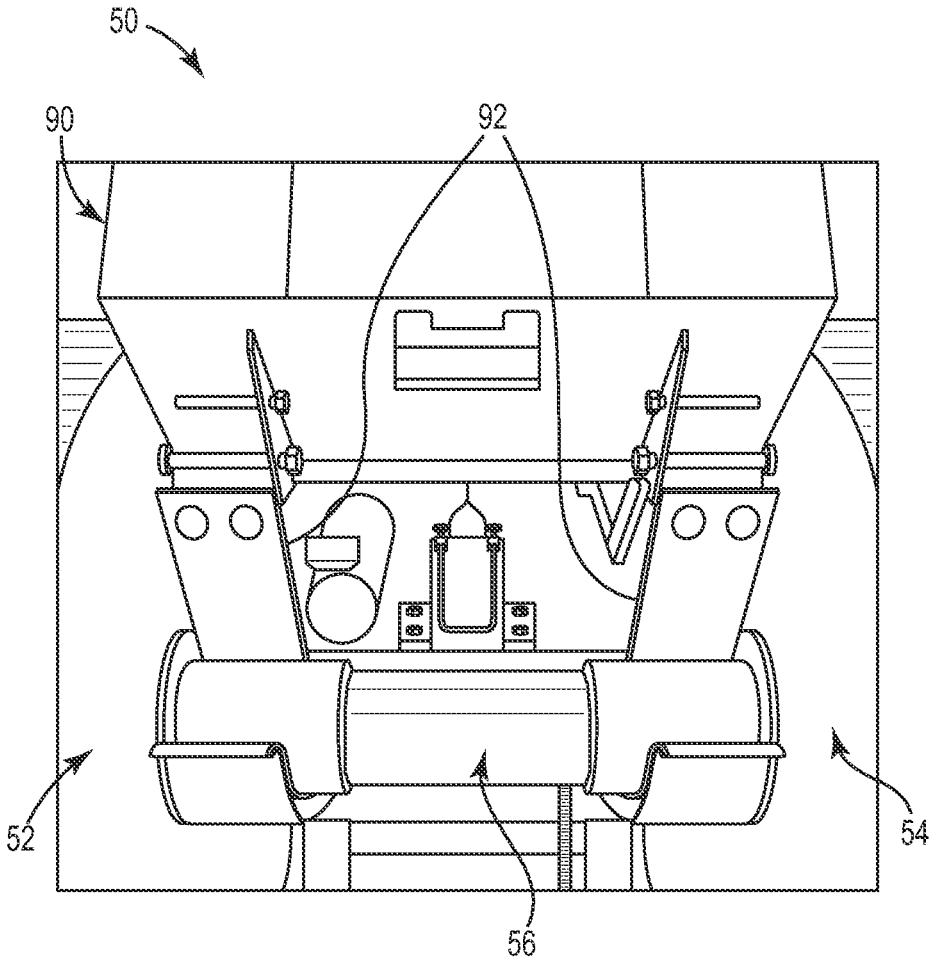
FIG. 10C is close-up, top perspective view of the deployment apparatus of FIG. 10A.
Figure 11A:
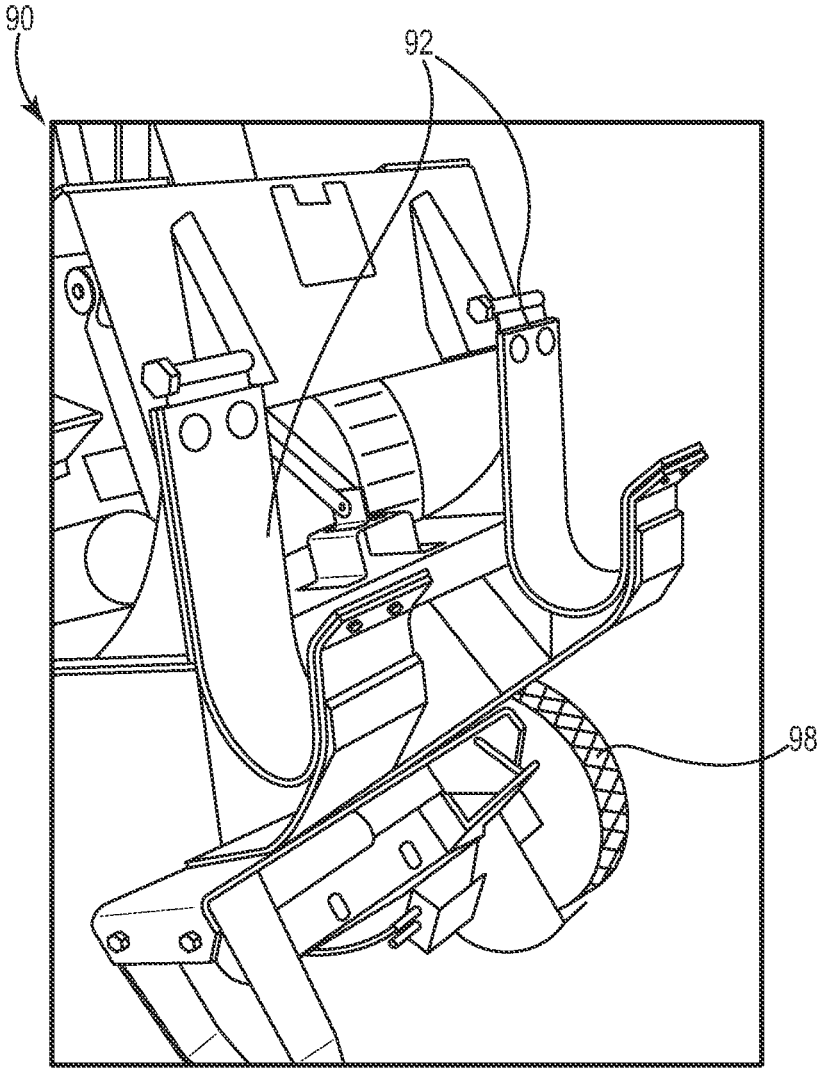
FIG. 11A is close-up, front perspective view of an exemplary mounting apparatus of the deployment apparatus of FIG. 10A.
Figure 11B:
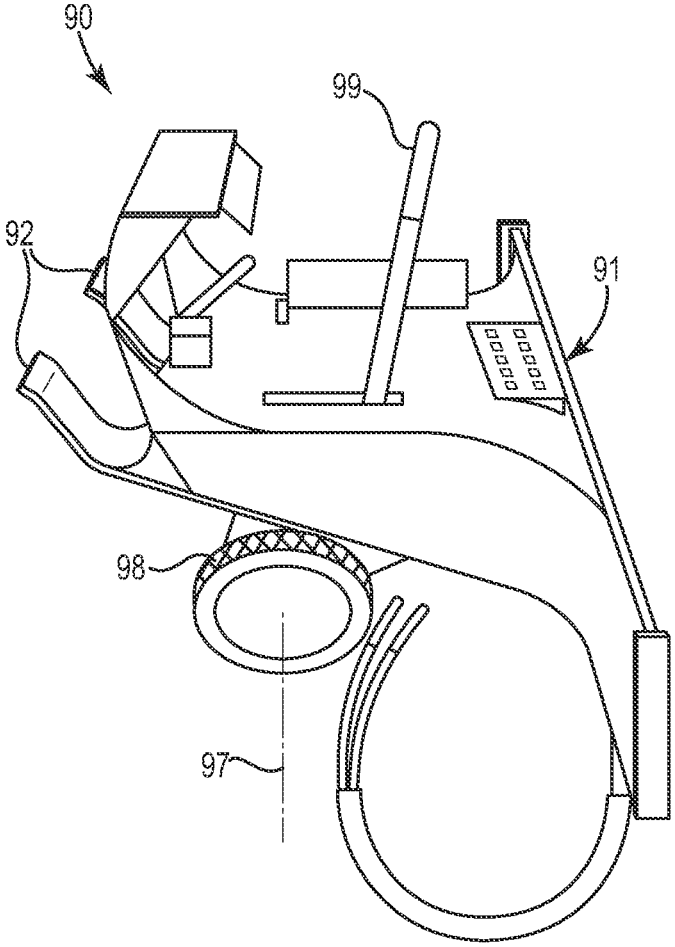
FIG. 11B is a side perspective view of the mounting apparatus of FIG. 11A.

The deployment apparatus 50 may be coupled to a vehicle 80 as shown in FIGS. 10A-10B. In addition to the spool portions 52, 54 and the axle portion 56, the deployment apparatus 50 may further including mounting portion 90 as shown in FIGS. 11A-11B couplable to the vehicle 80 and configured to hold the axle portion 56 and the spool portions 52, 54 above a ground surface. More specifically, the mounting portion 90 may include a mount plate 91 configured to be mounted to the front of a vehicle (e.g., a skid steer) as shown in FIG. 11B. Further, the mounting portion 90 may include one or more J-shaped brackets 92 configured to rotatably hold the axle portion 56 as shown in FIG. 10C.

As described herein, the deployment apparatus 50 may control rate of rolling or unrolling the tracks 10 from the spool portions 52, 54. In at least one embodiment, to achieve such control, the deployment apparatus 50 may further include a first engagement wheel 96 and a second engagement wheel 98. The first engagement wheel 96 may be fixedly coupled to one of the axle portion 56 and the spool portions 52, 54. In at least one embodiment, the first engagement wheel 96 may include one or more metal materials. As shown, the first engagement wheel 96 is fixedly coupled to the second spool portion 54. In at least one embodiment, the second engagement wheel 98 may include rubber tire on a metal rim.

The second engagement wheel 98 may be rotatably coupled to the mounting portion 90 and may be movable, or positionable, in at least an engaged and disengaged configuration. Generally, when the second engagement wheel 98 is in the engaged configuration, it is in contact with the first engagement wheel 96 so as to control the rate of rolling and unrolling of the tracks 10 from the spool portions 52, 54. For example, the second engagement wheel 98 may be in contact with the first engagement wheel 96 to apply reverse tension to the first engagement wheel 96 when in the engaged configuration. Further, when the second engagement wheel 98 is in the disengaged configuration, it may not be in contact with the first engagement wheel 96. As shown, handle 99 may be used to move the second engagement wheel 98 from the engaged configuration to the disengaged configuration and vice versa.

As shown in FIG. 11B, the second engagement wheel 98, when in the engaged configuration, may be in contact with the first engagement wheel 96 to apply reverse tension to the first engagement wheel 96. A hydraulic motor may be used to apply rotational force to the second engagement wheel 98 to, in turn, apply the reverse tension to the first engagement wheel 96. Generally, the reverse tension may apply a rotational force to the first engagement wheel 96 in the winding direction (e.g., the rotational direction that winds, or rolls, the tracks 10 onto the spool portions 52, 54) of the spool portions 52, 54. In other words, the spool portions 52, 54 may be biased in the winding direction by the engagement wheels 96, 98. As a result, when a driver drives forward to deploy the tracks 10, the wheels of the vehicle may pull and unwind the track 10 from the spool portions 52, 54 which are biased in the opposite direction such that the tracks 10 do not unwind or unroll by themselves. Further, when the driver drives backward to pick up the tracks 10, the reverse tension will slowly wind the tracks 10 on the spool portions 52, 54 keeping constant tension on the tracks 10 such that the tracks 10 do not unwind or unroll by themselves.

In other words, to roll out the tracks 10, one may begin by slowly driving a vehicle forward to release the tracks 10 onto the ground far enough so that the wheels (or tracks) of the vehicle are on top of the tracks 10. Then, a user may turn the hydraulic motor "on" to apply force to the second engagement wheel 98 which applies reverse tension to the first engagement wheel 96. This procedure will maintain tension on the tracks 10 so that they unwind off of the spool portions 52, 54 (e.g., like pulling line off of a fishing reel). Near the end of the roll out, a user may release the hydraulic rewind tension to allow the spool portions 52, 54 to turn freely so that the tracks 10 release from the spool portions 52, 54. To retrieve the tracks 10, a user may reconnect the metal rings 72 to the connector apparatus 66 (e.g., tongue portions 68) of the spool portions 52, 54 and switch the hydraulic motor "on" and move the vehicle in reverse. The reverse tension applied to the first engagement wheel 96 may maintain tight, compact rewinding of the tracks onto the spool portions 52, 54.

As shown in FIG. 11B, the second engagement wheel 98 may be further movable along a movement axis 97 (which is parallel to the spool axis 58) to allow for the spool width 60 adjustment. For example, if the spool width 60 is adjusted, the first engagement wheel 96 may move away from the second engagement wheel 98 in a direction parallel to the spool axis 58. Thus, the second engagement wheel 98 may be moved outwardly to engage the first engagement wheel 96.

The complete disclosure of the patents, patent documents, and publications cited in the Background, the Summary, the Detailed Description of Exemplary Embodiments, and elsewhere herein are incorporated by reference in their entirety as if each were individually incorporated. Exemplary embodiments of the present disclosure are described above. Those skilled in the art will recognize that many embodiments are possible within the scope of the disclosure. Other variations, modifications, and combinations of the various components and methods described herein can certainly be made and still fall within the scope of the disclosure.

The invention claimed is:

1. A track system along which, when deployed, a vehicle may move, wherein the track system comprises first and second rollable tracks, wherein each of the rollable tracks comprises:

a plurality of connected slat members forming a track length of the rollable track, wherein each of the plurality of connected slat members is formed of solid material and comprises:

a slat length extending from a first end to a second end, a slat width perpendicular to the slat length extending from a first connection interface to a second connection interface, wherein the slat width is less than the slat length, wherein the first connection interface of each slat member is slidably connectable to the second connection interface of a different slat member, wherein the first connection interface of each slat member comprises a tongue portion and the second connection interface of each slat member comprises a groove portion, wherein the tongue portion of the first connection interface of each slat member is receivable within the groove portion of the second connection interface of a different slat member to slidably connect the first connection interface to the second connection interface along a connection axis such that the connected slat members are partially rotatable relative to each other about the connection axis to allow the plurality of connected slat members to be rolled up into a roll, a slat thickness perpendicular to the slat width and the slat length, wherein the slat width is greater than the slat thickness, and at least one strap element coupled along the track length of the rollable track, wherein the at least one strap element is coupled to each of the plurality of connected slat members at a pivot point such that the connected slat members allow for a limited slidable movement relative to each other along the connection axis between connected slat members.

2. The system of claim 1, wherein the slat width of each slat member of the plurality of connected slat members is greater than at least twice the slat thickness of each of the plurality of connected slat members.

3. The system of claim 1, wherein each pivot point located along the length of the plurality connected slat members comprises a fastener placed through the at least one strap element and into the slat member.

4. The system of claim 1, wherein each rollable track comprises a first side and a second side along the track length, wherein the at least one strap element comprises a first strap element and a second strap element, wherein the first strap element is coupled along the track length between the midpoint of the slat length of connected slat members and the first side of the rollable track and the second strap element is coupled along the track length between the midpoint of the slat length of connected slat members and the second side of the rollable track.

5. The system of claim 1, wherein the at least one strap element comprises flexible material.

6. The system of claim 1, wherein the tongue portion of each of the plurality of connected slat members defines a T-shape.

7. The system of claim 1, wherein the connected slat members are partially rotatable such that one of the connected slat members is rotatable in a range of about 1 degrees to about 60 degrees relative to the adjacent connected slat member about the connection axis.

8. The system of claim 1, wherein the at least one strap element between connected slat members is flexible and the limited slidable movement between connected slat members is in a range of about 0.5 inches to about 2 inches.

9. The system of claim 1, wherein the slat length is more than twice the width of the vehicle's tires.

10. The system of claim 1, wherein the tongue portion of the first connection interface of at least one connected slat member is not received within the groove portion of the second connection interface of a different slat member to define a gap between connected slat members.

11. The system of claim 1, wherein each of the rollable tracks further comprises at least one connector element coupled to a connected slat member proximate an end region of the track length, wherein the at least one connector element is configured to couple the rollable track to another rollable track.

12. A method for deploying a track system comprising:

at least one track roll, each track roll comprising:

a plurality of connected slat members forming a track length of the rollable track, wherein each of the plurality of connected slat members is formed of solid material and comprises:

a slat length extending from a first end to a second end, a slat width perpendicular to the slat length extending from a first connection interface to a second connection interface, wherein the slat width is less than the slat length, wherein the first connection interface of each slat member is slidably connectable to the second connection interface of a different slat member, wherein the first connection interface of each slat member comprises a tongue portion and the second connection interface of each slat member comprises a groove portion, wherein the tongue portion of the first connection interface of each slat member is receivable within the groove portion of the second connection interface of a different slat member to slidably connect the first connection interface to the second connection interface along a connection axis such that the connected slat members are partially rotatable relative to each other about the connection axis to allow the plurality of connected slat members to be rolled up into a roll, and a slat thickness perpendicular to the slat width and the slat length, wherein the slat width is greater than the slat thickness, and at least one strap element coupled along the track length of the rollable track, wherein the at least one strap element is coupled to each of the plurality of connected slat members at a pivot point such that the connected slat members have a limited mobility relative to each other along the connected axis, and loading the at least one track roll onto a deployment vehicle, and unrolling the at least one track roll such that the plurality of connected slat members of each roll are deployed in front of the wheels of the vehicle such that the vehicle may drive thereon.

13. The method of claim 12, wherein the method further comprises controlling the rate of unrolling of the at least one track roll.

14. The method of claim 12, wherein loading the rolls comprises loading the at least one track roll in front of a cabin of the vehicle.

15. A deployment apparatus for use in a track system, wherein the track system comprises first and second rollable tracks, wherein the deployment apparatus comprises:

a first and a second spool portion for the first and second rollable tracks, respectively, wherein each spool portion of the first and second spool portions is configured to hold the rollable tracks above a ground surface, wherein each spool portion extends along a spool axis and is rotatable about the axis to roll and unroll the unrollable tracks from the spool portion, wherein each spool portion of the first and second pool portions defines connector apparatus configured to be coupled to a rollable track;

an axle portion coupled to each of the first and second spool portions and extending along the spool axis between the first and second spool portions;

a mounting portion couplable to a vechile and configured to hold the axle portion and the first and second spool portions above the ground surface, wherein the mounting portion is further configured to control the rate of rolling and unrolling of the first and second rollable tracks;

a first engagement wheel fixedly coupled to one of the axle and the first and second spool portions; and a second engagement wheel rotatably coupled to the mounting portion, wherein the second engagement wheel is positionable in an engaged configuration and a disengaged configuration, wherein the second engagement wheel is in contact with the first engagement wheel to apply reverse tension to the first engagement wheel when in the engaged configuration, and wherein the second engagement wheel is not in contact with the first engagement wheel when in the disengaged configuration.

16. The deployment apparatus of claim 15, wherein the second engagement wheel is movable along a movement axis parallel to the spool axis to engage the first engagement wheel.

17. The deployment apparatus of claim 15, wherein the mounting portion comprises at least one J-shaped bracket configured to interface with the axle portion to hold the axle portion and the first and second spool portions above the ground surface.

18. The deployment apparatus of claim 15, wherein a spool width is defined between the first and second spool portions, wherein the first and second spool portions and the axle portion are configured to allow the spool width to be adjustable.

* * * * *

UNITED STATES PATENT AND TRADEMARK OFFICE

CERTIFICATE OF CORRECTION

PATENT NO. : 8,784,002 B2
APPLICATION NO. : 13/554351
DATED : July 22, 2014
INVENTOR(S) : Gary J. Ringus et al.

It is certified that error appears in the above-identified patent and that said Letters Patent is hereby corrected as shown below:

In the Specification

In column 4, line 26, please delete “a” and replace with --an--.

In the Claims

In column 15, line 16, please insert --of-- between “plurality” and “connected”.

In column 16, line 45, please delete “unrollable” and replace with --rollable--.

In column 16, line 47, please delete “pool” and replace with --spool--.

Signed and Sealed this
Tenth Day of May, 2016

Michelle K. Lee

Michelle K. Lee
*Director of the United States Patent and Trademark Office*